US006079803A

United States Patent [19]

West et al.

[11] Patent Number: 6,079,803

[45] Date of Patent: Jun. 27, 2000

[54] CLOSET ORGANIZATION SYSTEM AND METHOD FOR INSTALLING SAME

[75] Inventors: Robert A. West, Shorewood, Minn.; Dale Aberegg, Mt. Vernon, Ohio; Brian K. Linstedt, Ostrander, Ohio; Mark W. Groves, Columbus, Ohio; Gregory J. Merz, Gahanna, Ohio; Stephen Bennett Moore, Loveland, Ohio

[73] Assignee: Westerlund Products Corporation, Minneapolis, Minn.

[21] Appl. No.: 09/017,371

[22] Filed: Feb. 2, 1998

[51] Int. Cl.[7] ..... A47B 77/00

[52] U.S. Cl. ..... 312/107; 211/90.02; 211/186; 312/263; 312/257.1; 312/265.4

[58] Field of Search ..... 312/233, 239, 312/107, 108, 263, 330.1, 257.1, 265.2, 265.1, 265.3, 265.4, 334.1, 334.7; 211/90.01, 90.02, 90.04, 186, 187

[56] References Cited

U.S. PATENT DOCUMENTS

| | | | |
|---|---|---|---|
| 204,237 | 5/1878 | Schneider et al. . | |
| 330,380 | 11/1885 | Cregmile . | |
| 563,467 | 7/1896 | Farwell | 211/153 |
| 622,666 | 4/1899 | Burwell | 211/153 |
| 779,262 | 1/1905 | Burke . | |
| 934,148 | 9/1909 | Duff . | |
| 1,682,060 | 8/1928 | Banks . | |
| 2,205,730 | 6/1940 | Morgan | 189/34 |
| 2,294,595 | 9/1942 | Dice | 211/43 |
| 2,545,844 | 3/1951 | Cougias | 211/43 |
| 2,888,305 | 5/1959 | Perry | 311/41 |
| 2,905,519 | 9/1959 | O'Neil | 312/350 |
| 3,061,395 | 10/1962 | Marateck et al. | 312/350 |
| 3,127,021 | 3/1964 | Nolen | 211/175 |
| 3,393,951 | 7/1968 | Sulentic | 312/283 |
| 3,400,829 | 9/1968 | Youngson | 211/86 |
| 3,465,763 | 9/1969 | Hoffman | 134/154 |
| 3,478,891 | 11/1969 | Kaeslin | 211/90.01 X |
| 3,624,780 | 11/1971 | Elliot et al. | 211/86 |
| 3,698,782 | 10/1972 | Onori | 312/350 |
| 3,828,937 | 8/1974 | Nash | 211/187 X |
| 3,836,218 | 9/1974 | Hallal | 312/111 |
| 3,891,288 | 6/1975 | Marquette | 312/338 |
| 3,966,056 | 6/1976 | Larson | 211/134 |
| 4,106,735 | 8/1978 | Partain et al. | 248/119 R |
| 4,125,078 | 11/1978 | Nyquist | 108/29 |
| 4,192,562 | 3/1980 | Bishoff et al. | 312/108 |
| 4,206,955 | 6/1980 | Cooper | 312/107 |
| 4,470,647 | 9/1984 | Bishoff et al. | 312/111 |
| 4,508,231 | 4/1985 | Honickman | 211/199 |
| 4,696,406 | 9/1987 | Karashima et al. | 211/153 |
| 4,718,132 | 1/1988 | Wirland | 5/11 |
| 4,723,665 | 2/1988 | Benedict et al. | 211/168 |
| 4,832,422 | 5/1989 | Fortmann | 312/330 |
| 4,928,833 | 5/1990 | Huizenga | 211/187 |
| 4,938,365 | 7/1990 | Conway et al. | 211/50 |
| 5,100,216 | 3/1992 | Enns | 312/263 |

(List continued on next page.)

OTHER PUBLICATIONS

Product Brochure #751–95, California Closets, Inc. (1995).

*Primary Examiner*—Peter M. Cuomo
*Assistant Examiner*—Stephen Vu
*Attorney, Agent, or Firm*—Schwegman, Lundberg, Woessner & Kluth, P.A.

[57] ABSTRACT

A closet organization system is provided which includes an apparatus and a method for installing same. The apparatus includes adjustable shelving and an adjustable clothes rod coupled to a console unit, which can further include additional shelving and also drawers. The console unit which includes posts having holes therein for receiving projections on the console shelves, and a drawer assembly, or inserts for use with adjustable shelving, the console shelves, and the drawer assembly. The closet organization system, fabricated from either word or lightweight plastic, is adapted to be easily assembled and easily disassembled. Additional brackets can secure the console unit to a wall, and brackets can be further included with the adjustable shelving to provide additional support.

19 Claims, 25 Drawing Sheets

U.S. PATENT DOCUMENTS

| | | | |
|---|---|---|---|
| 5,191,986 | 3/1993 | Huizenga | 211/189 |
| 5,277,512 | 1/1994 | Dwillies | 403/348 |
| 5,295,596 | 3/1994 | Squitieri | 211/175 |
| 5,337,905 | 8/1994 | Gast | 211/87 |
| 5,423,597 | 6/1995 | Rogers | 297/440 |
| 5,441,162 | 8/1995 | Niblock | 211/153 |
| 5,466,058 | 11/1995 | Chan | 312/111 |
| 5,549,377 | 8/1996 | Krivec | 312/334.8 |
| 5,582,306 | 12/1996 | Balter et al. | 211/187 |
| 5,586,666 | 12/1996 | Squitieri | 211/175 |
| 5,601,016 | 2/1997 | Witte | 108/106 |
| 5,605,238 | 2/1997 | Jacobs | 211/187 X |
| 5,819,958 | 10/1998 | Dement | 211/90.04 X |
| 5,826,955 | 10/1998 | Sanders et al. | 312/111 |

CLOSET ORGANIZATION SYSTEM AND METHOD FOR INSTALLING SAME

FIELD OF THE INVENTION

The present invention relates generally to organization systems and simplified method for installing the system, which systems can be used in closets, laundry rooms, pantries, basements, garages, or other places where storage is needed.

BACKGROUND OF THE INVENTION

As the emphasis on organization increases, consumers, and builders, are looking to make more efficient use of closet storage space to facilitate access to articles, and to permit a greater number of clothing articles to be stored in a given area. More complicated approaches to closet organization employ sophisticated modules that add shelves, shoe racks and the like to the conventional clothes pole. One approach involves coated wire shelving which is customized for each individual closet by the installer. The closet is measured, and then the wire shelving is cut to fit within the closet. To install the wire shelving, placement of the holes is measured and marked on the wall, holes are then drilled. Next, several small clips are attached the wall using screws inserted into the pre-drilled holes. This approach, however, has several drawbacks. The rough edges, if not properly covered, snag and ruin clothing. In addition, the cut edges tend to rust, which also can potentially damage clothing, and mar the walls.

Another approach involves providing customized dressers in combination with large wall sections which are professionally installed in a closet. These organizers are costly, and cannot be easily disassembled and/or reused in another configuration or closet.

The largest drawback to conventional closet organizers is that they tend to be difficult to install without prior experience and several tools. Levels, saws, tape measures, drills, adhesives, screws and drills may be required. One miscut or mismeasurement may ruin all or a portion of the closet system. Baseboards must be pried from the walls, causing damage to the walls and requiring repair and painting. Another drawback is that long shelves are difficult to fit through the closet door. In addition, the installer may mar the walls as the long shelves are carried through a house prior to installation due to the awkwardness of carrying the long pieces of material.

Accordingly, what is needed is a cost effective organizing system for increasing the useful space in a consumer's closet. What is further needed is an organizing system which will not damage clothing or articles placed thereon. What is also needed is an organizing system which requires no precise measurements to be taken and has a simplified installation. What is further needed is an organizing system which is both easily assembled and disassembled.

SUMMARY OF THE INVENTION

An organizational system is provided which includes, in one embodiment, an adjustable shelving apparatus and an adjustable clothes rod. The adjustable shelving apparatus has a first set of cross members slidably engaged with a second set of cross members. The adjustable clothes rod includes a first rod member and a second rod member, where the first rod member is slidably engaged with the second rod member. In another embodiment, the adjustable clothes rod and the adjustable shelving are coupled such that sliding movement of the shelving apparatus slidably moves the adjustable clothes rod.

In another configuration, the organizational system includes an adjustable shelving apparatus and at least two console posts, where the adjustable shelving apparatus is coupled with the console posts. In an alternative configuration, a cam lock assembly is included with the adjustable shelving apparatus, where the cam lock assembly secures the adjustable shelving apparatus with at least one of the console posts. The cam lock assembly can be modified to include a cam lock and a cam ping, and securing the cam pin to a portion of the adjustable shelving apparatus. In addition, a coupling insert is provided, in another embodiment, which couples with a portion of the adjustable shelving apparatus and a portion of the console posts.

In another embodiment, the organizational system includes an adjustable shelving apparatus and a console unit having at least two console posts, where the console unit includes at least one storage device coupled between the at least two console posts. The storage device, in one embodiment, comprises a console shelf. In another embodiment, the storage device comprises a drawer and/or a console shelf. To secure the drawer within the console unit, the console unit also can include a drawer assembly. The drawer assembly includes a drawer with a first engaging profile, and at least one drawer rail having a second engaging profile, where the first engaging profile is slidably engaged by the second engaging profile. The drawer rail has coupling features which allow for the drawer rail to be removably coupled with the console posts. A bracket can also be provided with the console unit to secure the console unit to a mounting surface. In addition, a header can also be provided with the console unit which couples to console posts together, thereby forming a more secure structure.

The adjustable shelving of the closet organization system provides several benefits since it can accommodate many different closets having different widths. This provides a user the added benefit of not having to worry about accurate measurement prior to purchasing the shelving. In addition, a user does not need to cut the shelving to fit, which is desirable since no cutting tools are necessary during the installation process. The chance of jagged edges at the ends of the shelves, which can snag and damage clothing, is eliminated since the adjustable shelving does not need to be cut when it is installed. The adjustable shelf also eliminates the frustration and cost of making mistakes in cutting the shelving material. Another benefit is that the shelving can be made from recycled materials, and themselves be recycled.

The closet organization system provides many advantages over conventional systems. For instance, the closet organization system accommodates numerous sizes and configurations of different spaces where the system is needed. In addition, the closet organization system can be assembled, disassembled, removed and altered with minimal skill and with use of a single tool, the Phillips Head screwdriver, and also without significantly marring the wall. The closet organization system locks together to form a sturdy and strong structure, yet can be disassembled with speed and ease. The structure of the closet organization system is inexpensive to manufacture and is capable of being compactly stored when disassembled since it is extruded of inexpensive and lightweight plastic. The compactness and lightweight features allow for the organization system to be conveniently provided to consumers in the form of kits, which can vary depending on the areas in need of organization.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the spirit and scope of the present invention. Therefore, the following detailed description is not to be taken in a limiting sense, and the scope of the present invention is defined by the appended claims.

Figure 1:
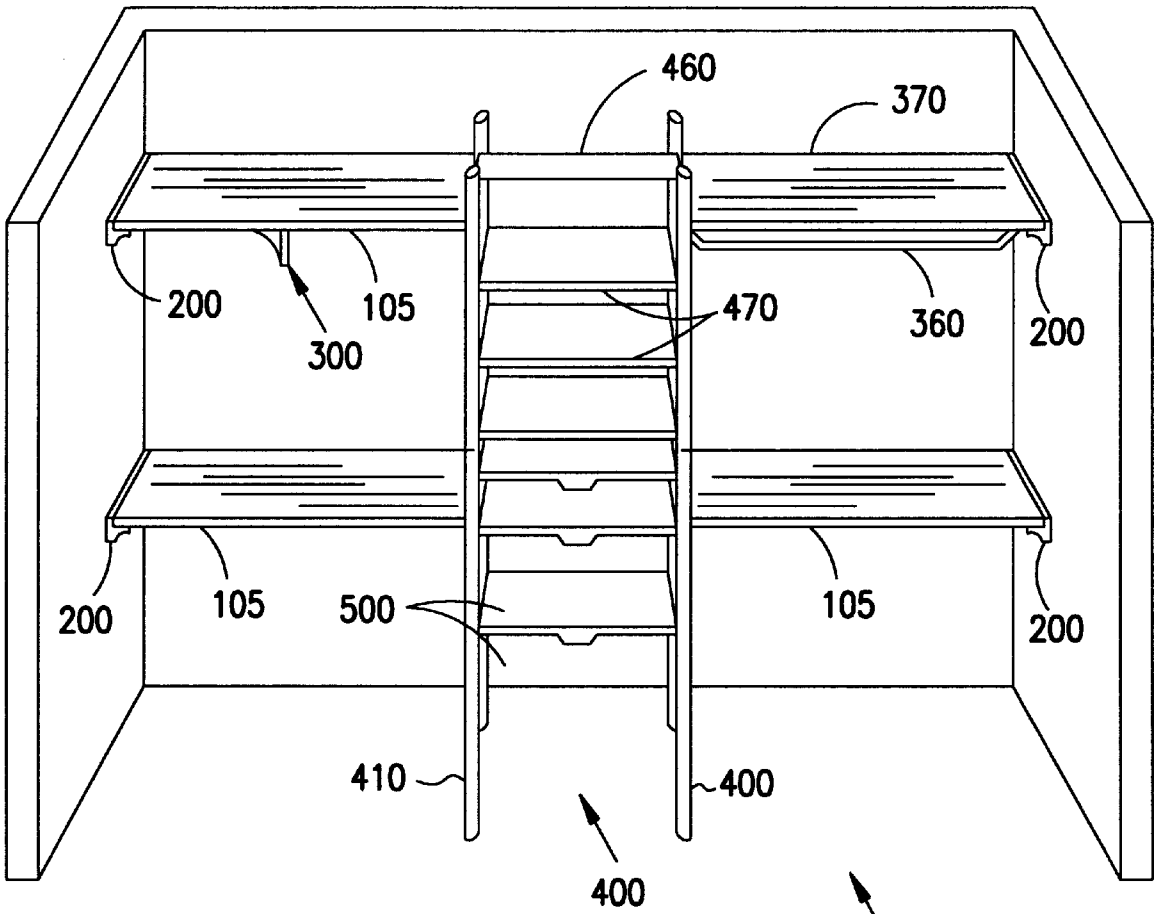
FIG. 1 illustrates an organization system constructed in accordance with one embodiment of the present invention.

FIG. 1 illustrates a first embodiment of the present invention. An organization system 100 is provided which comprises, in one embodiment, an adjustable shelving apparatus 105, an adjustable rod 360, and a console unit 400. In another embodiment, the console unit 400 also has a top header 460, at least one console shelf 470, and also a drawer 500. These components are adjustably arranged to accommodate various storage areas including closets, children's rooms, basements, kitchen pantries, laundry rooms, garages, etc. The organization system 100 can have many variations of these components including various combinations of the above, including, but not limited to, configurations where a single component is provided with other components, or configurations where multiple components are provided. The organization system 100 provides an organized storage area which is adjustable and will accommodate many different sizes of storage areas.

Figure 2:
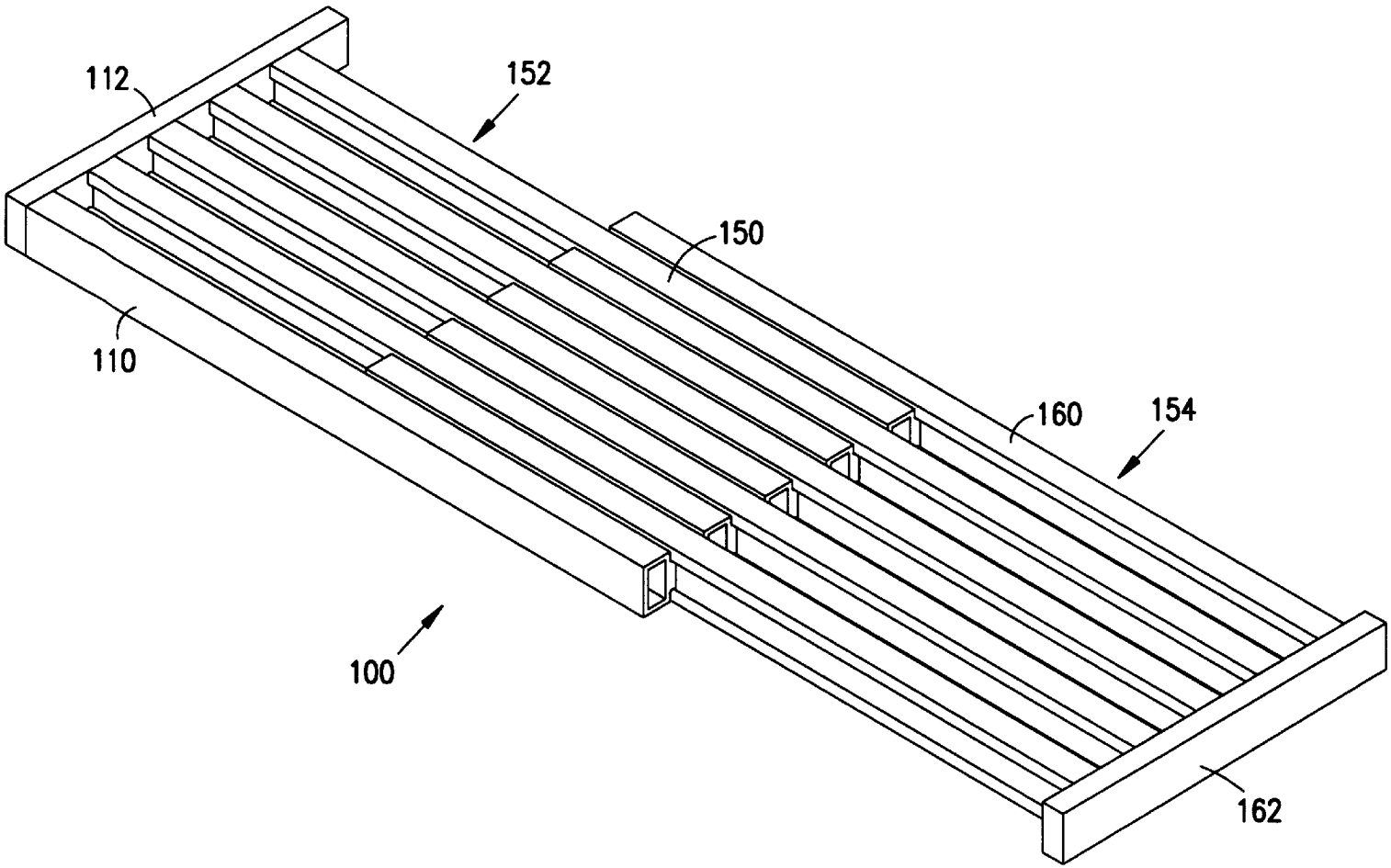
FIG. 2 illustrates a perspective view of adjustable shelving constructed in accordance with another embodiment of the organization system.

FIG. 2 illustrates one component of the organization system 100, the adjustable shelving apparatus 105. In one embodiment, the shelving apparatus 105 comprises a first set of cross members 110 and a second set of cross members 160. The first set of cross members 110, in another embodiment, slidably engage with the second set of cross members 160. The first set of cross members 110 coupled with the second set of cross members 160 form an adjustable general shelving area since the overall length of the shelving apparatus 105 can be modified as needed. The shelving area can consist of a planar surface 150 and also vented surfaces 152, 154. The first set of cross members 110 has, in one embodiment, individual cross members which are coupled by an end bracket 112. The adjustable shelving apparatus 105 illustrated in FIG. 2 is just one example of the various configurations which can be used within the scope of the invention. Many other embodiments are possible, such as those described in application Ser. No. 09/017,445, filed on Feb. 2, 1998, and assigned to Westerlund Products Corporation, which entire application is incorporated herein by reference.

Referring again to FIG. 2, the first set of cross members 110 can be joined with the end bracket 112 in a number of manners. For instance, in one embodiment, the cross members 110 and the end bracket 112 are joined together using a mechanical component such as a threaded fastener or a nail, or connected using a mortise and tenon arrangement. Alternatively, the cross members 110 and the end bracket 112 can be joined using adhesive. In yet another embodiment, the end bracket 112 and the cross members 110 can all be formed integrally out of a solid piece of material. The second set of cross members 160 similarly can be coupled with an end bracket 162. The end bracket 162 can be coupled with the second set of cross members 160 similar to the variety of manners as discussed above for the first set of cross members 110. The adjustable shelving apparatus 105 will accommodate many different closets and storage areas having a variety of widths.

Figure 3A:
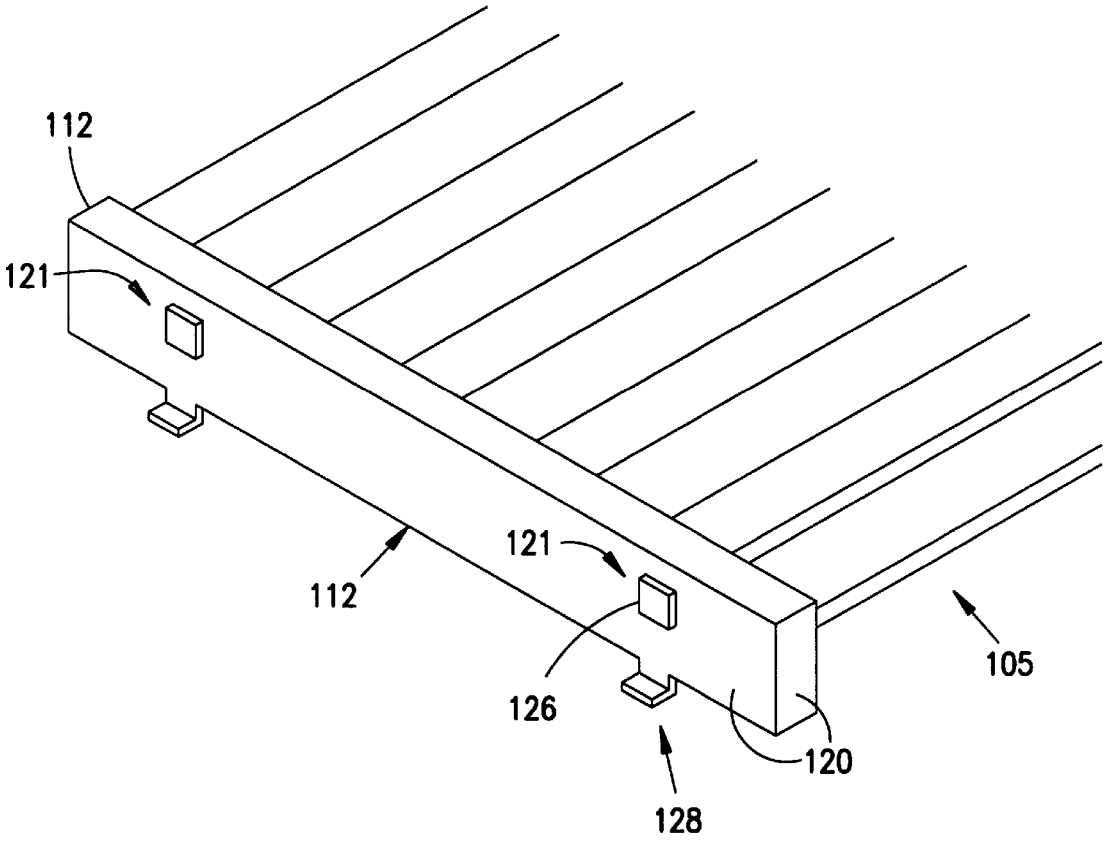
FIG. 3A is a perspective view illustrating another embodiment of the adjustable shelving constructed in accordance with one embodiment of the organization system.

FIG. 3A illustrates another embodiment of the adjustable shelving apparatus 105. In this configuration, the adjustable shelving apparatus 105 has an end bracket 112 which is defined in part by outer surfaces 120. Disposed on one of the outer surfaces 120, in one embodiment, are coupling features 121 which can connect the adjustable shelving apparatus 105 with other components of the organization system 100 or a mounting surface. In one embodiment, the coupling features 121 comprise a peg 126 and a leg member 128. The peg 126 comprises, in one embodiment, a flange portion 132 and a cylindrical portion 134. The peg 126 is sized and adapted to be received by an opening of a console post or a mounting bracket, as will be further described below. The leg member 128 comprises, in another embodiment, an L-shaped member which is also adapted to be received by an opening of a console post or various mounting brackets.

Figure 3B:
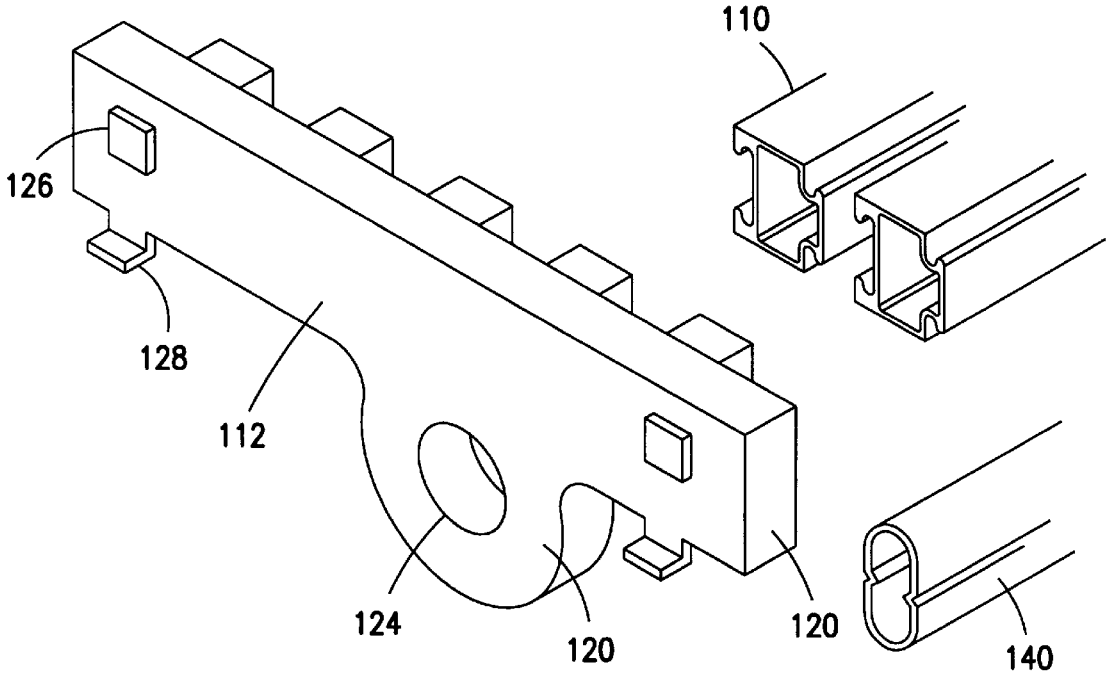
FIG. 3B illustrates a perspective view of an end bracket and adjustable shelving constructed in accordance with yet another embodiment of the organization system.

FIG. 3B illustrates yet another embodiment of the adjustable shelving apparatus 105. The end bracket 112 is defined in part by outer surfaces 120. Disposed on one of the outer surfaces 120, in one embodiment, are coupling features which can connect the adjustable shelving apparatus 105 with other components of the organization system 100 or a mounting surface. In one embodiment, the coupling features comprise a peg 126 and a leg member 128. The peg 126 comprises, in one embodiment, a flange portion 132 and a cylindrical portion 134. The peg 126 is sized and adapted to be received by an opening of a console post or a mounting bracket, as will be further described below. The leg member 128 comprises, in another embodiment, an L-shaped member which is also adapted to be received by an opening of a console post or various mounting brackets. Alternatively, in another embodiment, the outer surfaces 120 can have a plurality of pegs 126 and leg members 128. In addition, the end bracket 112 has a bore 124 therein. The bore 124, in one embodiment, is sized and adapted to receive other components therethrough. For instance, the bore 124 can allow for a clothes rod 140 to be inserted therethrough.

Figure 4A:
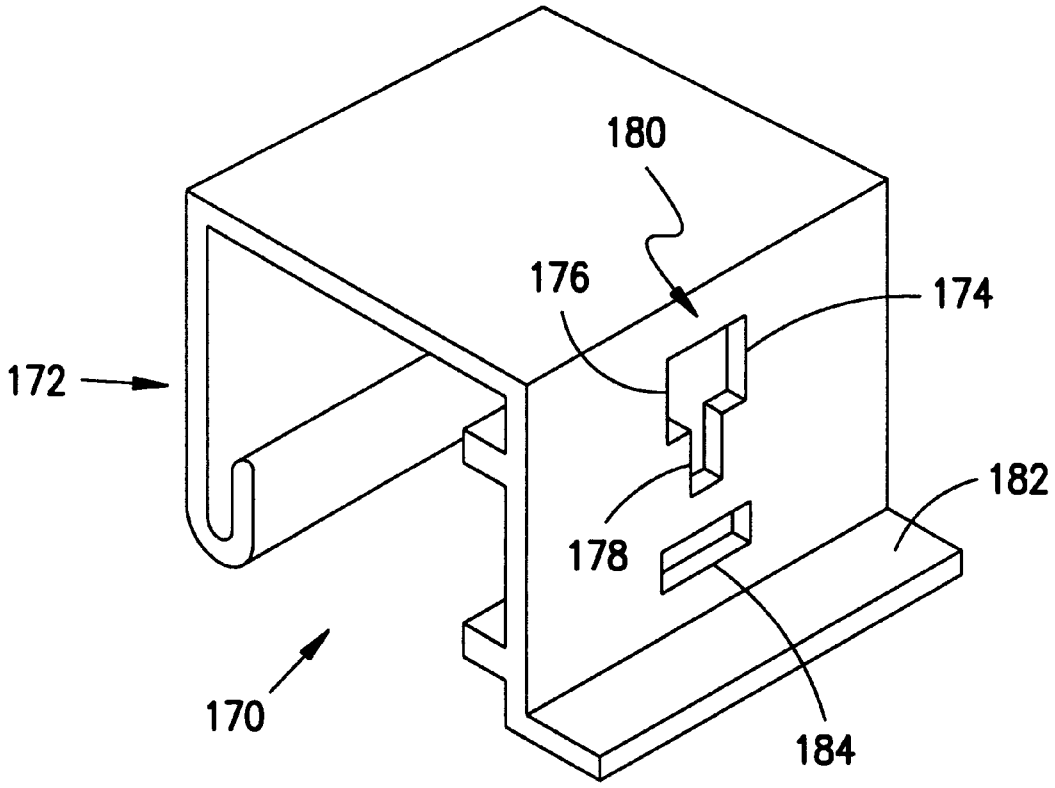
FIG. 4A is a perspective view of a corner bracket constructed in accordance with another embodiment of the organization system.
Figure 4C:
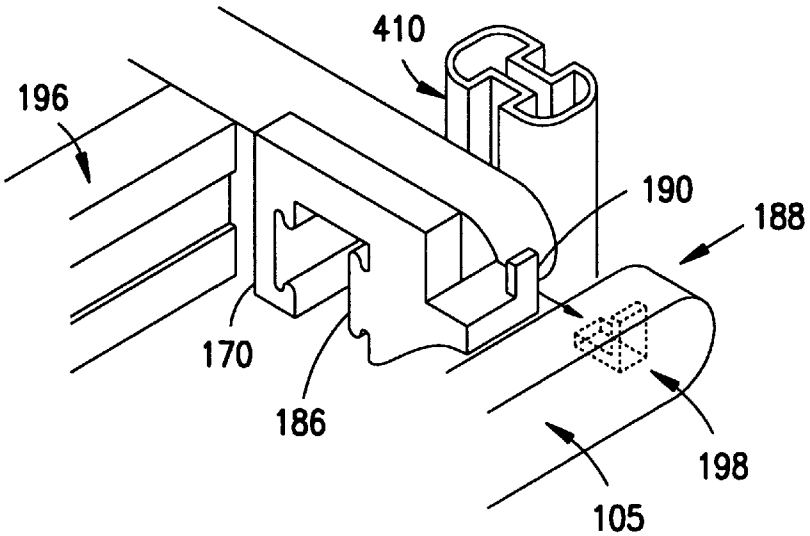
FIG. 4C is a perspective view of a corner bracket constructed in accordance with another embodiment of the organization system.
Figure 4B:
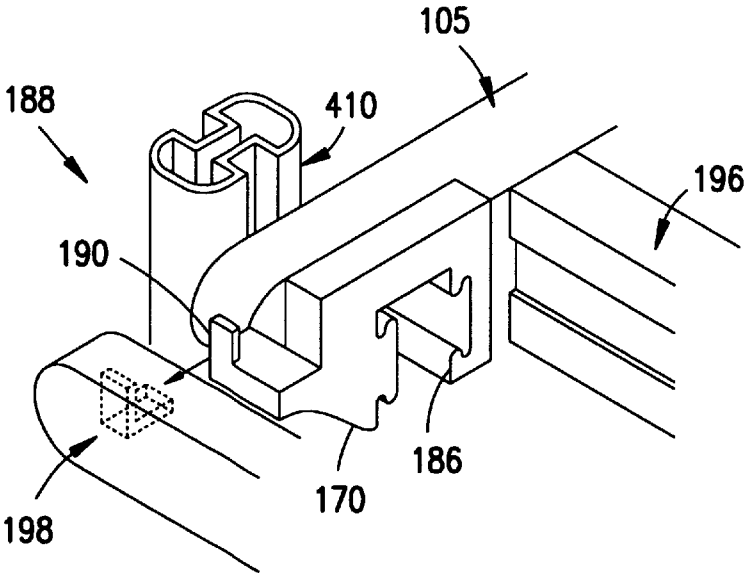
FIG. 4B is a perspective view of a corner bracket constructed in accordance with another embodiment of the organization system.

When installing an organization system 100 into a closet, the user has the option to configure the adjustable shelving apparatus and the console in just about any manner desired. In some instances, more than one adjustable shelving apparatus 105 may be used. In addition, if there is more than one adjustable shelving apparatus 105, they can be disposed at right angles to one another using a corner bracket 170 as illustrated in FIGS. 4A, 4B, and 4C. In one embodiment shown in FIG. 4A, the corner bracket 170 generally comprises in one embodiment an engaging feature 172, and a ledge 182. The ledge 182, although optional, provides additional support to an adjacently mounted adjustable shelving apparatus 105 when mounted thereon.

The engaging feature 172 allows the corner bracket 170 to be coupled with another adjustable shelving apparatus 105 such that another shelving apparatus 105 can be transversely mounted thereto. The engaging feature 172 is adapted to securely couple with a portion of the adjustable shelving apparatus 105 on either side of at least one of the members. The engaging feature 172 can have a number configurations, depending on the adjustable shelving apparatus. In another embodiment, the corner bracket 170 also comprises coupling features 180 for connecting with other components of the organization system 100, such as the adjustable shelving apparatus 105. In one embodiment, the coupling features 180 include an opening 174 and/or a cut out 184. The opening 174 is adapted to receive therein engaging structure on the end bracket 112 of the adjustable shelving apparatus 105. The opening 174, in one embodiment, consists of a hole 176, a slot 178. The corner bracket 170 clips over the adjustable shelving apparatus 105 and allows for right or left turns for the plane of shelving available to a user. To couple the corner bracket 170 with openings of other components, the peg 126 and the leg member 128 of the other components snap into the corner bracket 170.

In another embodiment of the corner bracket 170 shown in FIGS. 4B and 4C, the corner bracket 170 has coupling features 188 and an internal profile 186. In one embodiment, the internal profile 186 corresponds with the profile of an individual member 196 of the adjustable shelving assembly. The profiles can be modified to create an orientation specific bracket 170, as shown in FIG. 4B and FIG. 4C. The coupling features 188, in another embodiment, comprise a projection 190 which engages with a cut out 198 of the shelving assembly 105. Two corner brackets 170 can be provided to fit with two different cut outs 198 of the shelving assembly 105. To install the corner bracket 170, the bracket 170 slides over one member 196 of the adjustable shelving assembly 105 prior to assembly of the shelving assembly 105. The shelving assembly 105 to be installed fits over the projection 190 of the corner bracket 170, where the projection 190 engages the cut out 198 of the shelving assembly 105.

Figure 5:
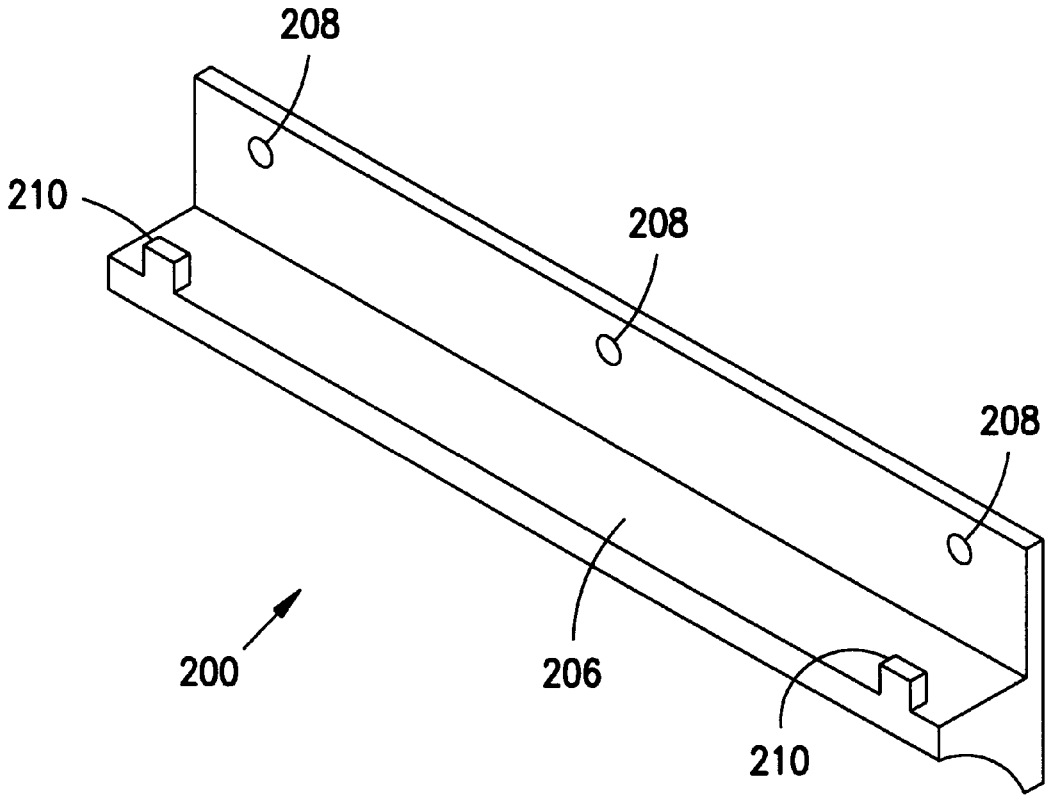
FIG. 5 is a perspective view illustrating a right angle shelf bracket constructed in accordance with one embodiment of the organization system.
Figure 17:
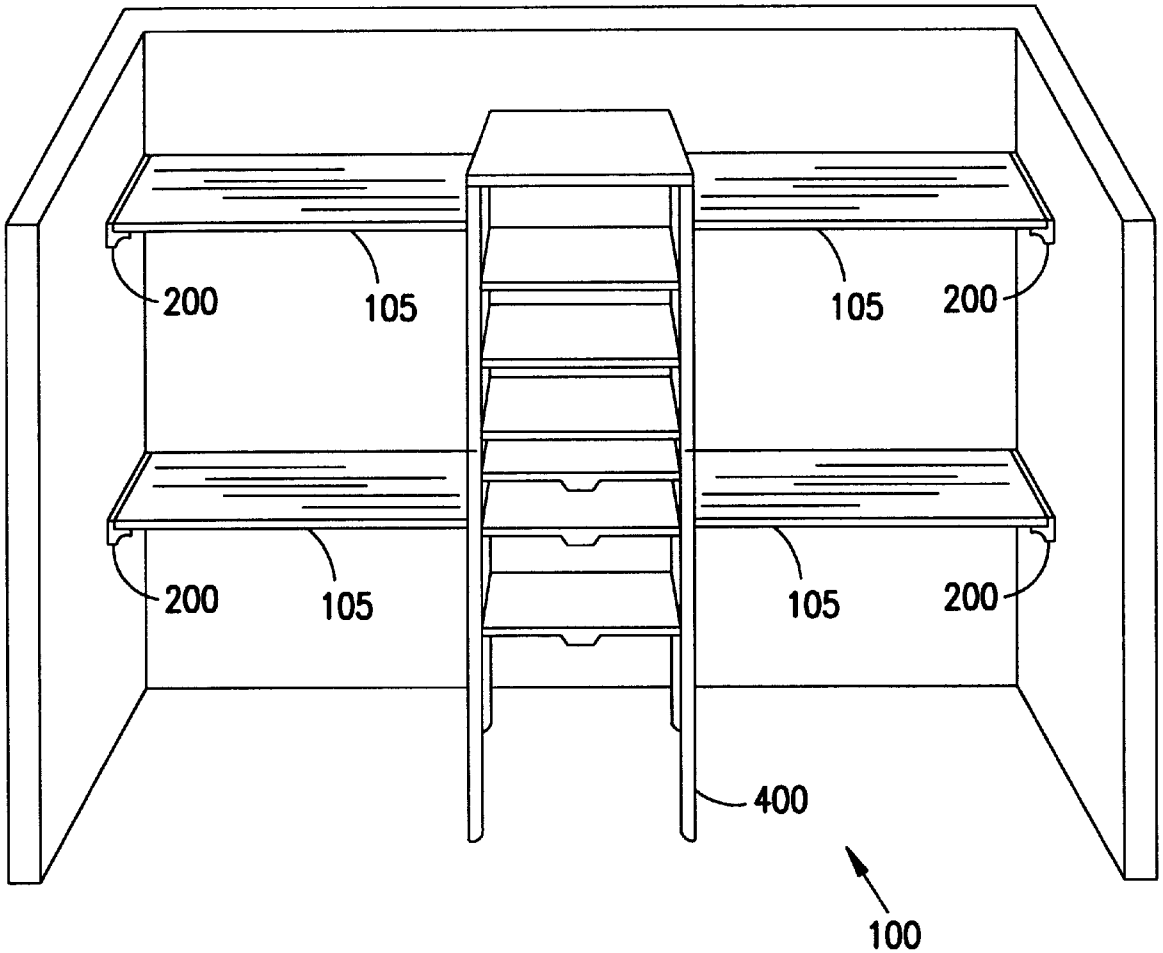
FIG. 17 is a view illustrating an organization system constructed in accordance with one embodiment of the present invention.
Figure 19:
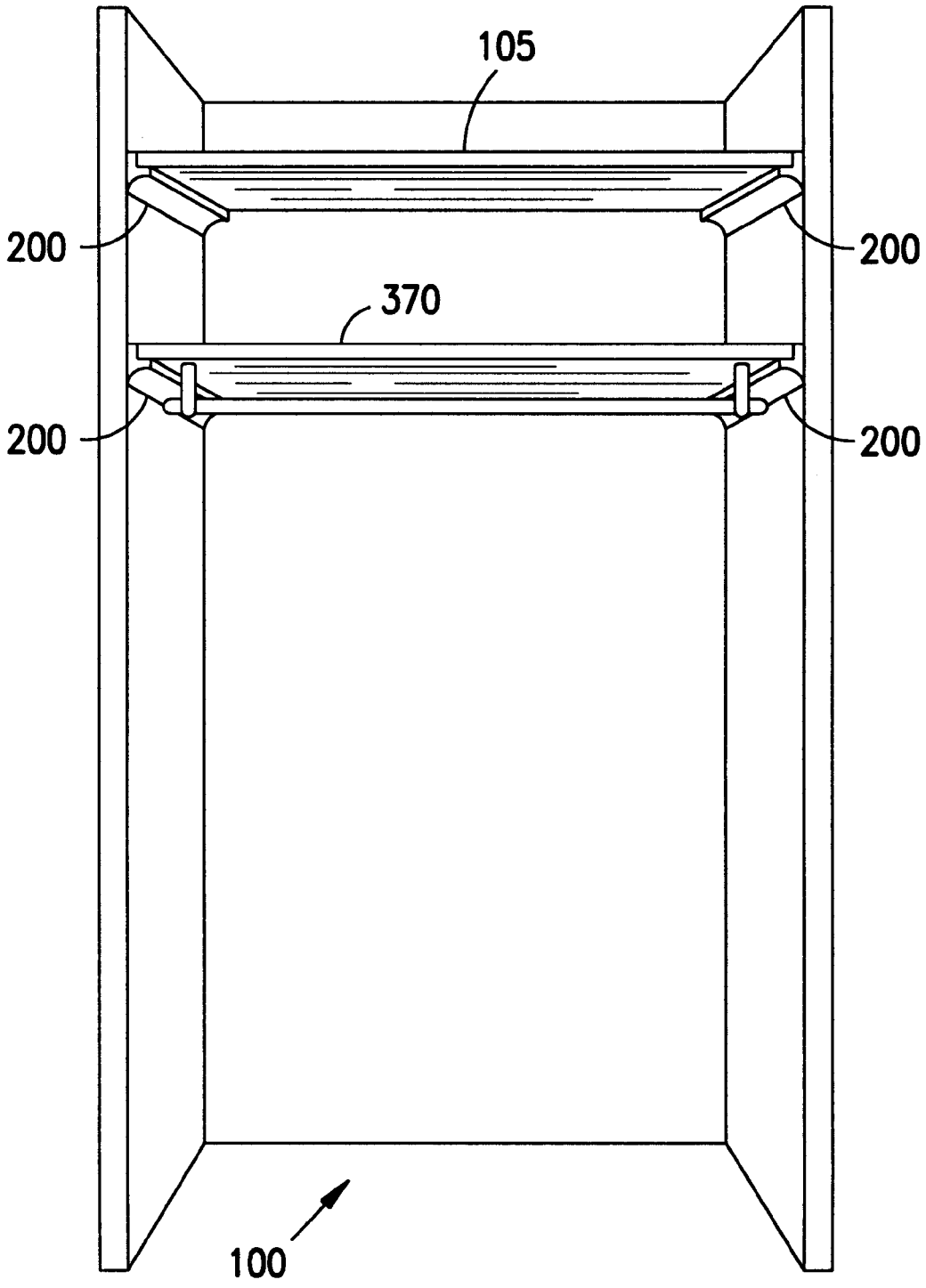
FIG. 19 is a view illustrating an organization system constructed in accordance with one embodiment of the present invention.

The shelving assembly 105 of the organization system 100 can also be installed to mounting surfaces, such as walls of a closet. (See FIGS. 17 and 19). To achieve this configuration, a right angle shelf bracket 200 can be used. FIG. 5 illustrates one embodiment of a right angle shelf bracket 200 of the organization system 100. The right angle shelf bracket 200 includes, in one embodiment, a shelf portion 206 which provides support for the shelving assembly 105. Disposed on the shelf portion 206 is at least one projection 210. The projection 210 is adapted to be received by a cut out 224 (FIG. 6A) of the shelving apparatus 105. In addition, the right angle shelf bracket 200 also includes at least on mounting aperture 208. To install the shelf bracket 200, threaded fasteners or an anchor bolt are installed through each mounting aperture 208. Either a second shelf bracket 200 can be installed, or a console unit is then installed. A shelving assembly 105 is then installed between the two shelf brackets 200, as shown in FIG. 19, or between the shelving bracket 200 and the console unit 400, as shown in FIG. 17. The shelving assembly 105 to be installed fits over the projection 190 of the corner bracket 170, where the projection 190 engages the cut out 198 of the shelving assembly 105.

Figure 6A:
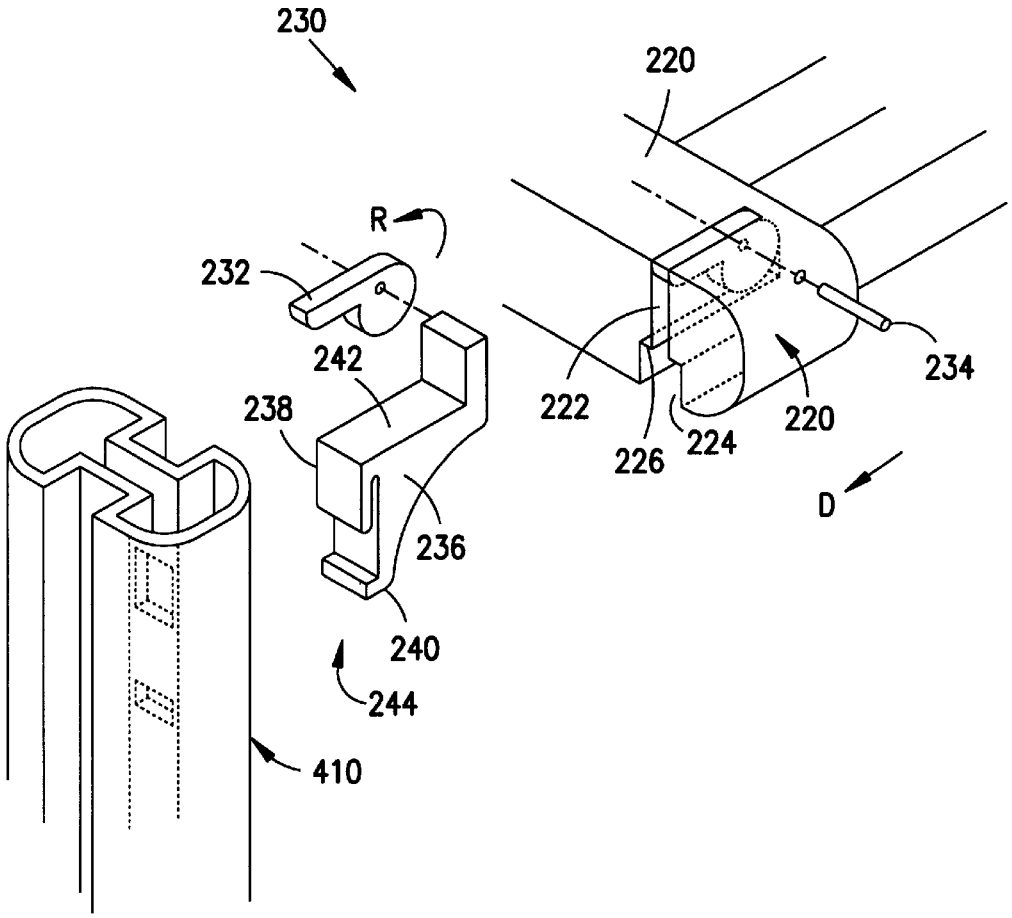
FIG. 6A is a perspective view illustrating a cam lock assembly constructed in accordance with another embodiment of the organization system.
Figure 6B:
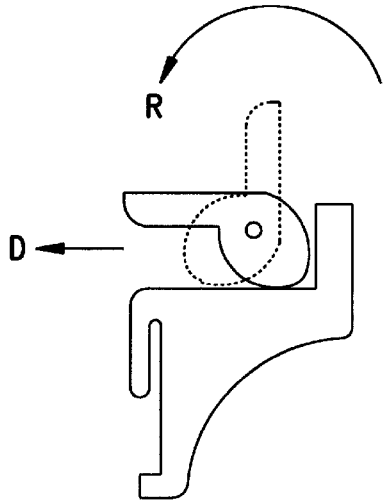
FIG. 6B is a side view illustrating a cam lock assembly constructed in accordance with another embodiment of the organization system.

Once a user has installed an adjustable shelving apparatus 105 within the organization system 100, the user may desire to more firmly secure the shelving in place. FIGS. 6A and 6B illustrate a cam lock assembly 230 optionally used in conjunction with the adjustable shelving apparatus 105 to provide a more secure organization system 100 when installed. Alternatively, other structures can be used to stabilize or more securely assembly the organization system 100, which are considered within the scope of the invention. A shelving end bracket 220 is provided, in one embodiment, with the cam lock assembly 230. The end bracket 220 has a first cutout 222 and a second cutout 224 to receive the cam lock assembly 230 therein.

The cam lock assembly 230 comprises, in one embodiment, a cam lock 232 and a cam pin 234. The cam pin 234 is coupled with the end bracket 220 and the cam lock 232 rotates about the cam pin 234. As the cam lock 232 is rotated about the cam pin 234 in the direction indicated as R, the end bracket 220 and the adjustable shelving apparatus 105 are thereby drawn toward the direction marked D into a tighter constraint with a console post. The cam lock assembly 230 can take a number of variations in size, shape, position, etc. and still be considered within the scope of the invention. For instance, the direction R is not limited to that shown in the Figure since the cam pin 234 can be coupled with the end bracket 220 in a number of configurations. The cam lock assembly 230 can also be used to securely couple many other components of the organization system 100.

In another embodiment, the end bracket 220 also includes a cam lock insert 236. The cam lock insert 236 is coupled with the end bracket 220 and also coupled with the cam lock assembly 230. In one configuration, the cam lock insert 236 is seated within the second cutout 224 of the end bracket 220, where the cam lock insert 236 engages the end bracket 220. The cam lock insert 236 is coupled with the end bracket 220 such that movement of the cam lock 232 causes movement of the cam lock insert 236 and the end bracket 220. In one embodiment, rotation of the cam lock 232 toward a console post draws the cam lock insert 236 and the end bracket 220 securely into the console post. In another embodiment, the cam lock insert 236 also includes coupling features 244. The coupling features 244 provide a structure to couple with other components of the organization system 100, such as the console post. In one embodiment, the coupling features comprise a peg 238 and a leg member 240. The peg 238 and the leg member 240 couple with corresponding structure on a console post which will be further described below.

Figure 7:
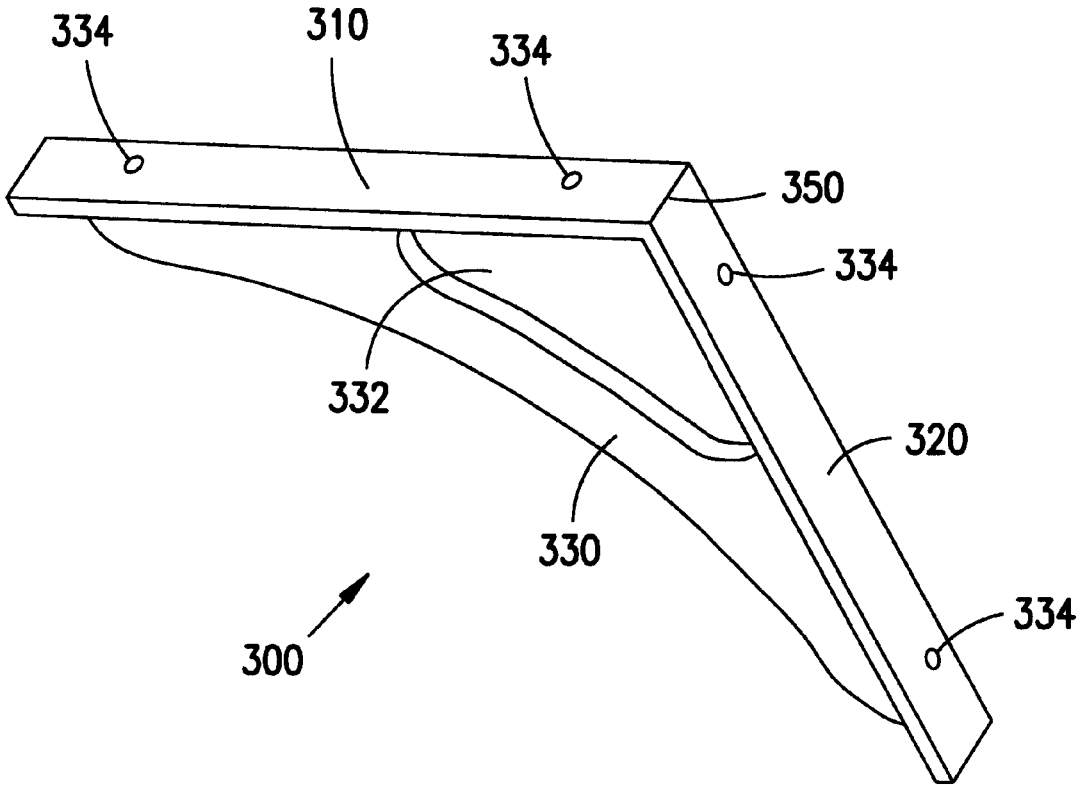
FIG. 7 is a perspective view illustrating a support bracket constructed in accordance with one embodiment of the organization system.

After an adjustable shelving apparatus 105 has been installed with other components of the organization system 100 or between two mounting surfaces, it may be beneficial to add additional support structure when the shelving apparatus is used in places such as a closet, particularly if heavy objects are to be placed on the shelving apparatus 105. FIG. 7 illustrates one example of a support bracket to be used in combination with the shelving apparatus. A support bracket 300 is shown having a first member 310 and a second member 320. The first member 310 is coupled with the second member 320 at an apex 350. In addition, a brace structure 330, in one embodiment, is disposed between the first member 310 and the second member 320, forming a cavity 332 therein. The first member 310 is disposed, in one embodiment, at approximately a 90° angle to the second member 320, although other angles may also be desirable and are considered within the scope of the invention. The support bracket 300 is also provided with a plurality of mounting holes 334. In another configuration, only one mounting hole is provided to secure the support bracket 300 to a wall.

The support bracket 300 is assembled such that the second member 320 is coupled with a wall 340, as shown in FIG. 1. Retaining members, such as threaded fasteners, can be used to secure the second member 320 with the wall 340. In another embodiment, the shelving apparatus 105 is coupled to the first member 310. In another alternative configuration, the shelving apparatus 105 can be coupled independently with a wall 340. The support bracket 300 advantageously provides additional support for the shelving apparatus 105 for situations where heavy objects are being placed upon the shelving apparatus 105.

Figure 8A:
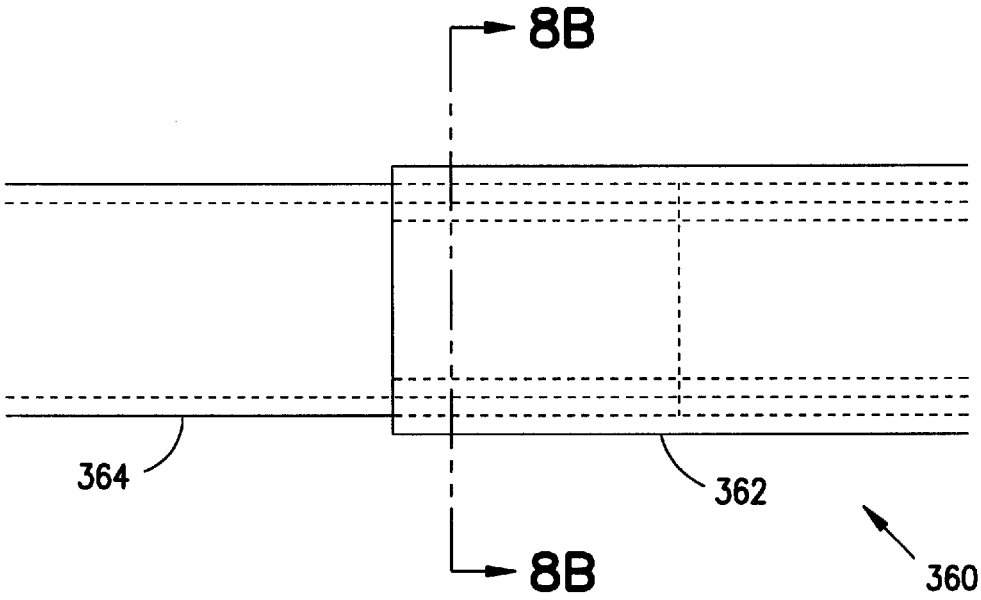
FIG. 8A is a side view illustrating an adjustable clothes rod constructed in accordance with one embodiment of the organization system.
Figure 8B:
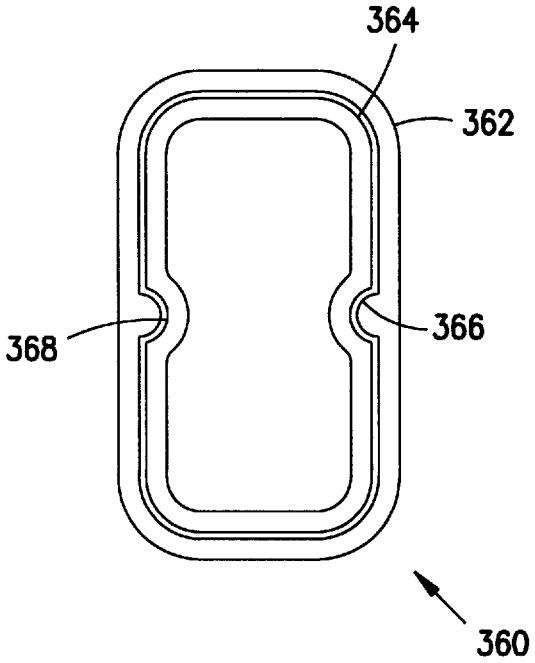
FIG. 8B is a cross-sectional view taken from FIG. 8B—8B of an adjustable clothes rod constructed in accordance with another embodiment of the organization system.

As discussed above, the adjustable shelving apparatus 105 can be, depending on the embodiment, provided with or without an adjustable clothing rod. The adjustable clothing rod 360 is shown in FIGS. 8A and 8B. The adjustable clothing rod 360 is comprised of at least a first rod member 362 and a second rod member 364. Alternatively, in other configurations, the adjustable clothing rod 360 can have additional members. The first rod member 362 slidingly receives therein the second rod member 364. Although several configurations are possible, one profile of the first and second rod members 362, 364 are shown in the FIG. 8B. The first rod member 362 is sized to receive the second rod member 364 therein. In one configuration, the first and second rod members 362, 364 have a guide 366 and track 368 assembly associated therewith. This assembly allows the first rod member 362 to slide relative to the second rod member 364 to thereby provide an adjustable clothing rod 360 which can vary in length similar to the adjustable shelving apparatus 105. Alternatively, other configurations are also possible for the adjustable clothing rod 360, and are considered within the scope of the invention. For instance, the adjustable clothing rod 360 can achieve adjustability by having telescoping members.

Figure 9:
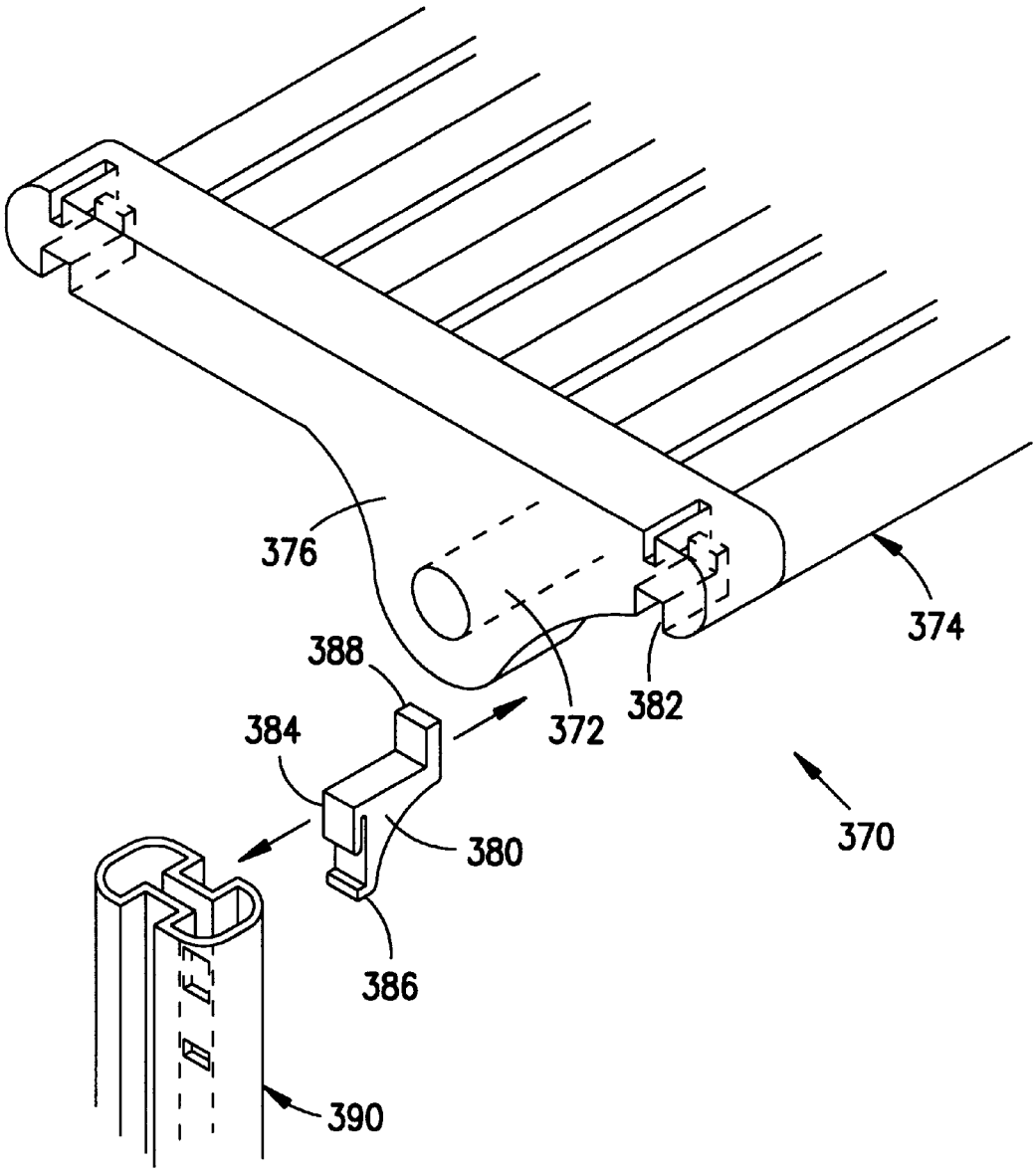
FIG. 9 is a perspective view illustrating a shelving assembly constructed in accordance with yet another embodiment of the organization system.

FIG. 9 illustrates a shelving and rod assembly 370. The shelving and rod assembly 370 comprises, in one embodiment, a combination adjustable clothing rod 372 and an adjustable shelving apparatus 374. In one embodiment, the clothing rod 372 is coupled with an end bracket 376 of the shelving apparatus 374. The clothing rod 372 and the shelving apparatus 374 are coupled such that extension of the shelving apparatus 374 extends the clothing rod 372, and vice versa. The adjustability of the components can be achieved in a number of manners. For instance, the clothing rod 372 and the shelving apparatus 374 can each have two members which slidably engage with one another. Alternatively, the clothing rod 372 and the shelving apparatus 374 can be comprised of telescoping components. Having the shelving and rod assembly 370 with adjustable length allows for the assembly 370 to be installed into a wide variety of storage locations without the need for detailed measurements, nor having to cut the assembly.

The shelving and rod assembly 370, in another embodiment, is provided with coupling features 378. In one embodiment, the coupling features 378 comprise a coupling insert 380 and a slot 382. The end bracket 376 has a slot 382 which is adapted to receive the coupling insert 380 therein. The coupling insert 380, in one embodiment, has a peg 384 and a leg member 386. The peg 384 and leg member 386 are adapted to couple with other components of the organization system 100, such as the console post 390, which will be further described below. In addition, the insert has a projection 388 which engages a portion of the end bracket 376 and retains the adjustable shelving 374 to a console post 390. The coupling features 378 allow for the shelving and rod assembly 370 to be easily and securely assembled with and disassembled from other components of the organization system 100.

Figure 10A:
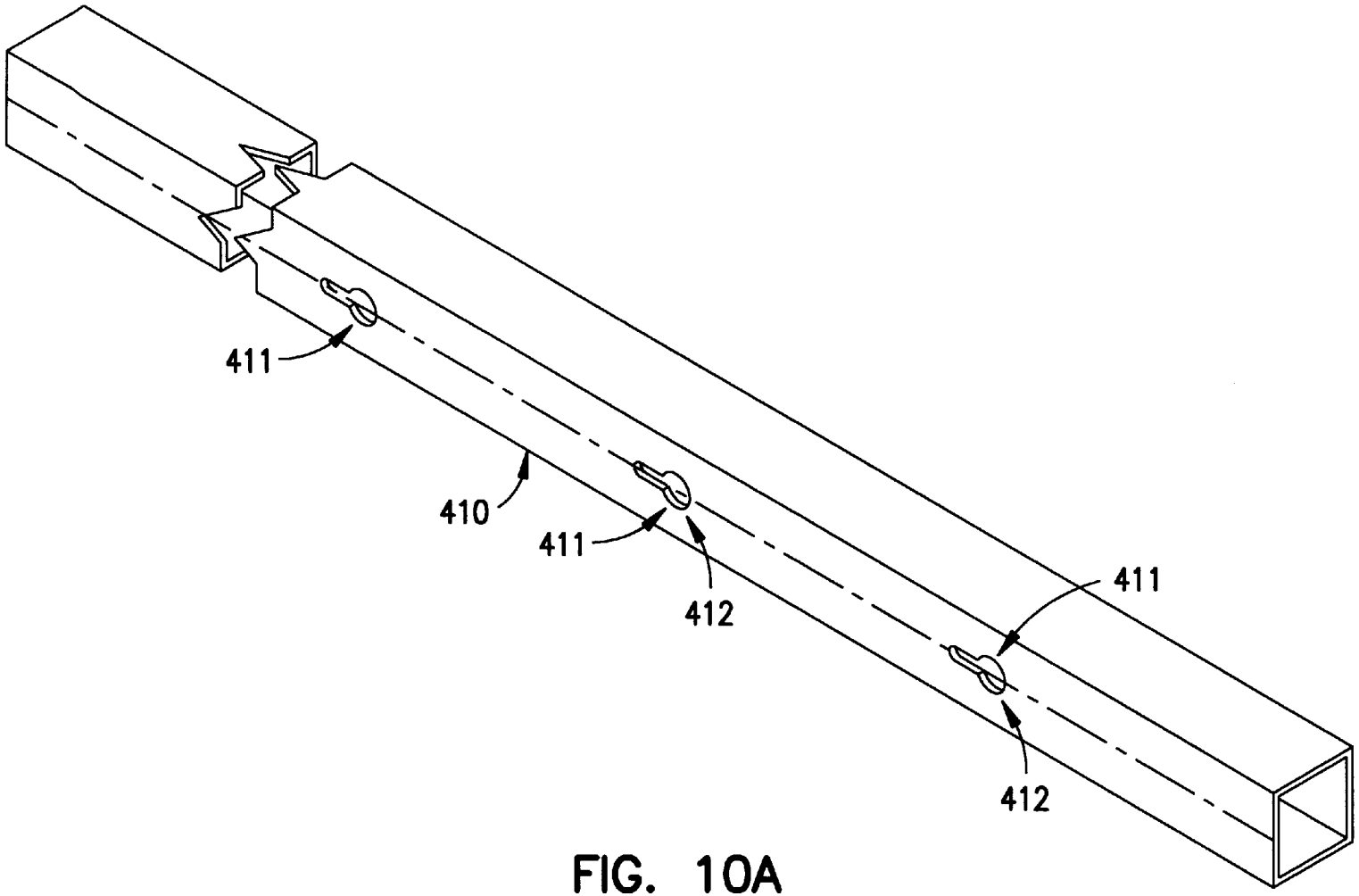
FIG. 10A is a perspective view illustrating a console post constructed in accordance with another embodiment of the organization system.
Figure 10B:
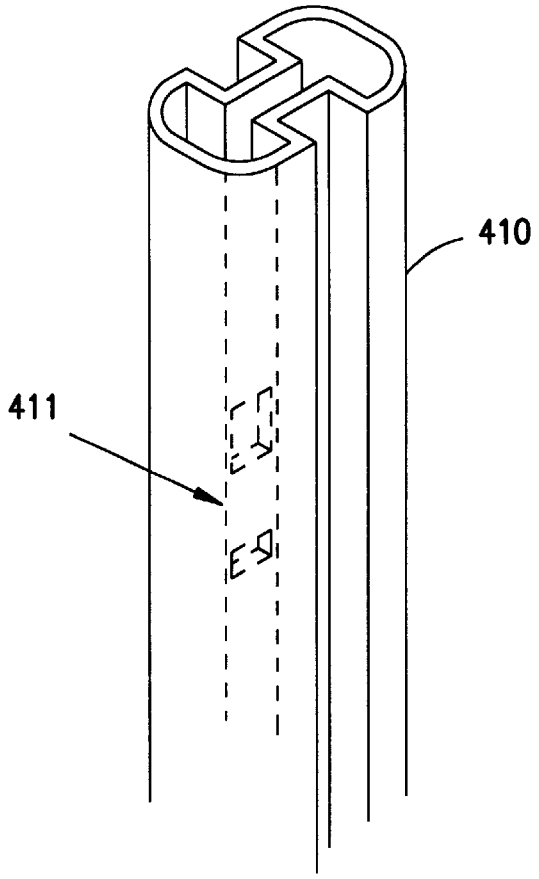
FIG. 10B is a perspective view illustrating a console post constructed in accordance with another embodiment of the organization system.
Figure 10C:
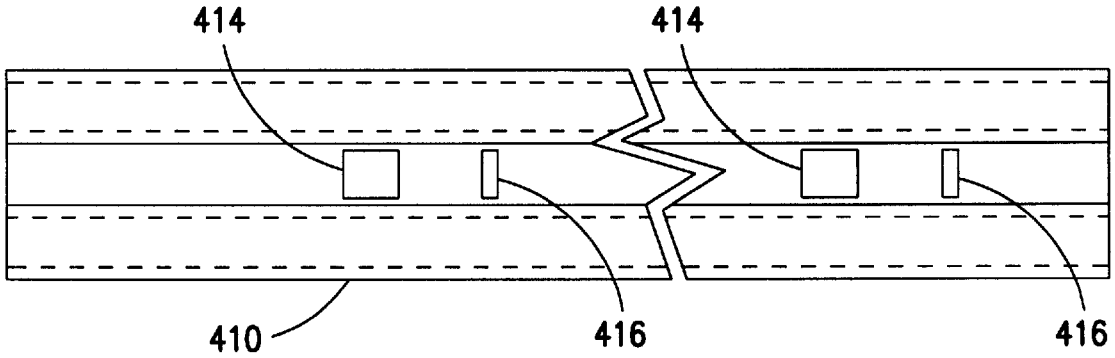
FIG. 10C is a side view illustrating a console post constructed in accordance with another embodiment of the organization system.

The adjustable shelving apparatus 105 or the many different variations discussed above can be mounted to a wall of a closet or other area in need of organization, or it can be mounted to a console unit 400 of the organization system 100. In one embodiment, the console unit 400 is comprised of at least one console post 410 as illustrated in FIG. 10A. The console post 410 has an elongate structure with a wide variety of profiles. In one configuration, the console post 410 has a square-shaped cross section. Alternatively, in another configuration, the console post 410 has an eight-shaped cross section, as shown in FIGS. 10B and 10C.

The console post 410 has, in one embodiment, coupling features 411 associated therewith. In another embodiment, as illustrated in FIGS. 10B and 10C, the coupling features 411 comprise a hole 414, and a slot 416. The hole 414 and the slot 416 are sized and adapted to receive a peg and leg member therein. In another configuration, the coupling features 411 are adapted to receive a coupling insert therein (FIG. 13). In yet another embodiment, at least one hole 414 and at least one slot 416 are provided, however, a plurality of holes 414 and slots 416 can also be provided to accommodate adjustability of the installation of shelving and the location of additional components to be discussed below. The plurality of openings can be disposed, in one example, every two inches or every four inches so that a user can install various components of the organization system 100 at various heights. The openings can be disposed, however, in any pattern.

Figure 11A:
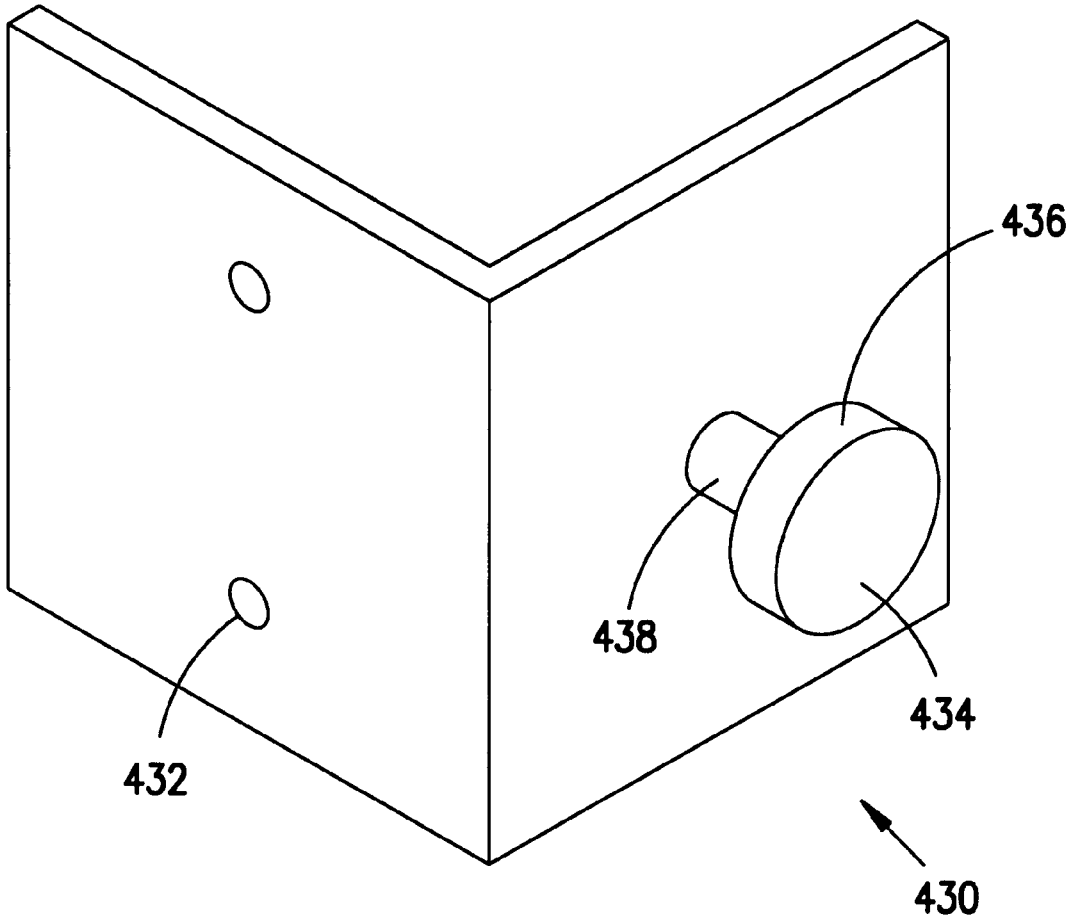
FIG. 11A is a perspective view illustrating a corner bracket constructed in accordance with one embodiment of the organization system.

The console unit 400 can be a free-standing unit where it is set on a floor surface, or it can be secured to a wall. The console unit 400 can be secured to a wall in a number of manners. The console unit 400 can be directly secured to the wall using a threaded fastener, anchor bolts, adhesives, or a bracket. FIG. 11A illustrates one example of a structure which can be used to install the console unit 400 or secure it to a wall. A post bracket 430 is provided which aids in securing a console post 410 to a wall. The post bracket 430 can have a number of configurations, however, it includes mounting holes 432 and coupling features. The coupling features of the post bracket 430 allow the bracket 430 to be connected with the console unit 400 In one embodiment, the coupling features comprise at least one peg 434. In another embodiment, the peg 434 comprises a flange 436 and a cylindrical portion 438. The peg 434 is sized and adapted to be received by the opening of the console post 410.

Figure 11B:
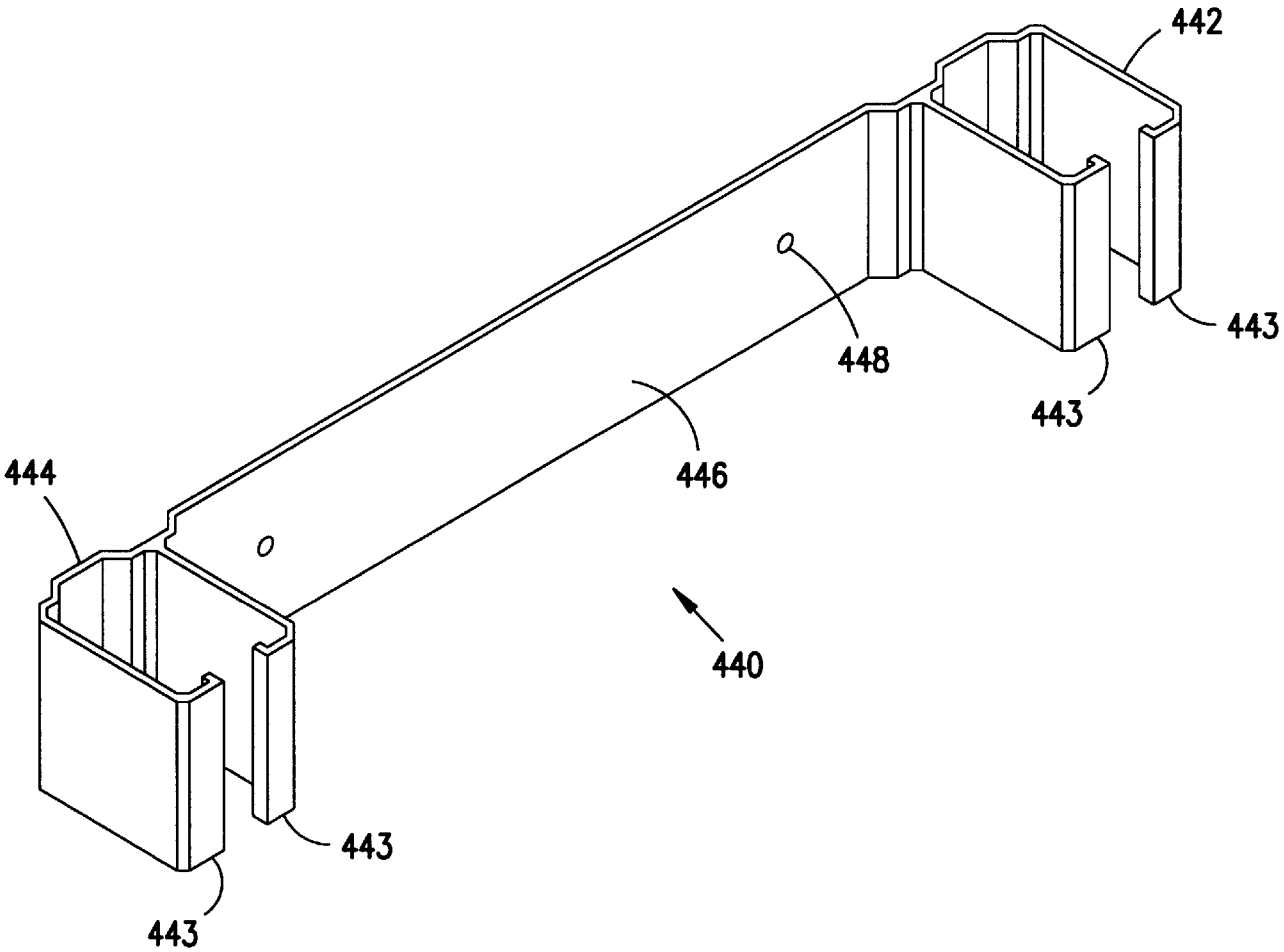
FIG. 11B is a perspective view illustrating a retaining bracket constructed in accordance with another embodiment of the organization system.

FIG. 11B illustrates another example of a bracket which can be used to secure the console post 410 to a wall or other support structure. A retaining bracket 440 is provided having a first coupling 442 and a second coupling 444. The couplings 442, 444 are each used to retain a console post 410 therein. In one embodiment, the couplings 442, 444 have fingers 443 which engage with a portion of the console post 410. The retaining bracket 440 also includes a mounting member 446 to join the first coupling 442 with the second coupling 444 and to provide further securement to the console unit 400. Disposed within the mounting member 446, in one embodiment, are mounting apertures 448. The mounting apertures 448 are sized to receive threaded fasteners therethrough such that the retaining bracket 440 can be secured to a wall. In another embodiment, the first coupling 442 and the second coupling 444 are positioned such that each console post 410 disposed within the couplings 442, 444 is offset slightly away from the wall. This configuration allows for the console post 410 to be installed up against baseboards which may be in a closet.

Figure 12A:
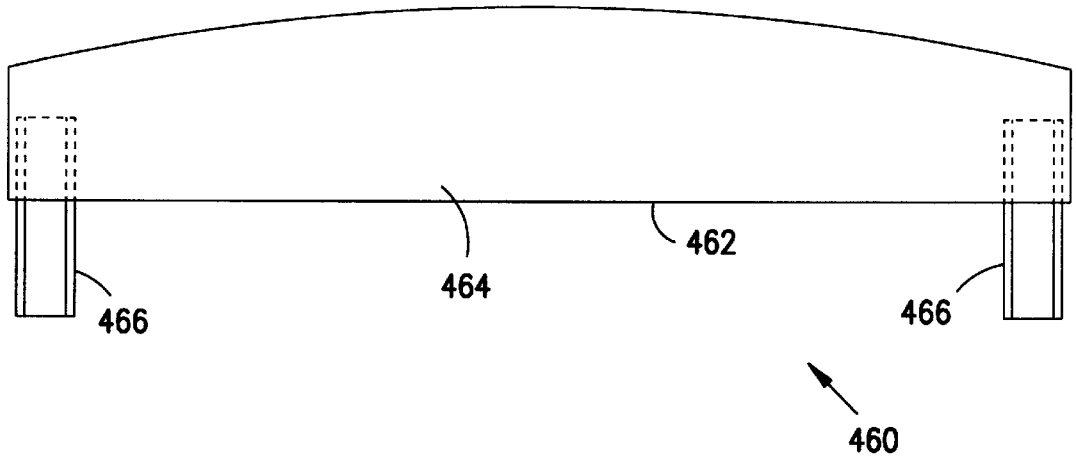
FIG. 12A is a side view illustrating a top header constructed in accordance with another embodiment of the organization system.

The console unit 400 also includes, in another embodiment, a header 460. One example of the header 460 is a top header 462 is illustrated in FIG. 12A. The top header 462 includes at least one coupling 466 for joining the top header 462 with the console posts. In addition, the top header 462 includes a crown 464. The coupling 466 of the top header 462 allows for the console post to be further secured by the top header 462. The crown 464 can be used to modify or enhance the ornamental features of the console unit 400. In another embodiment, a plurality of couplings 466 can be used. The couplings 466, in one embodiment, are sized and positioned to be received by the console post 410.

Figure 12B:
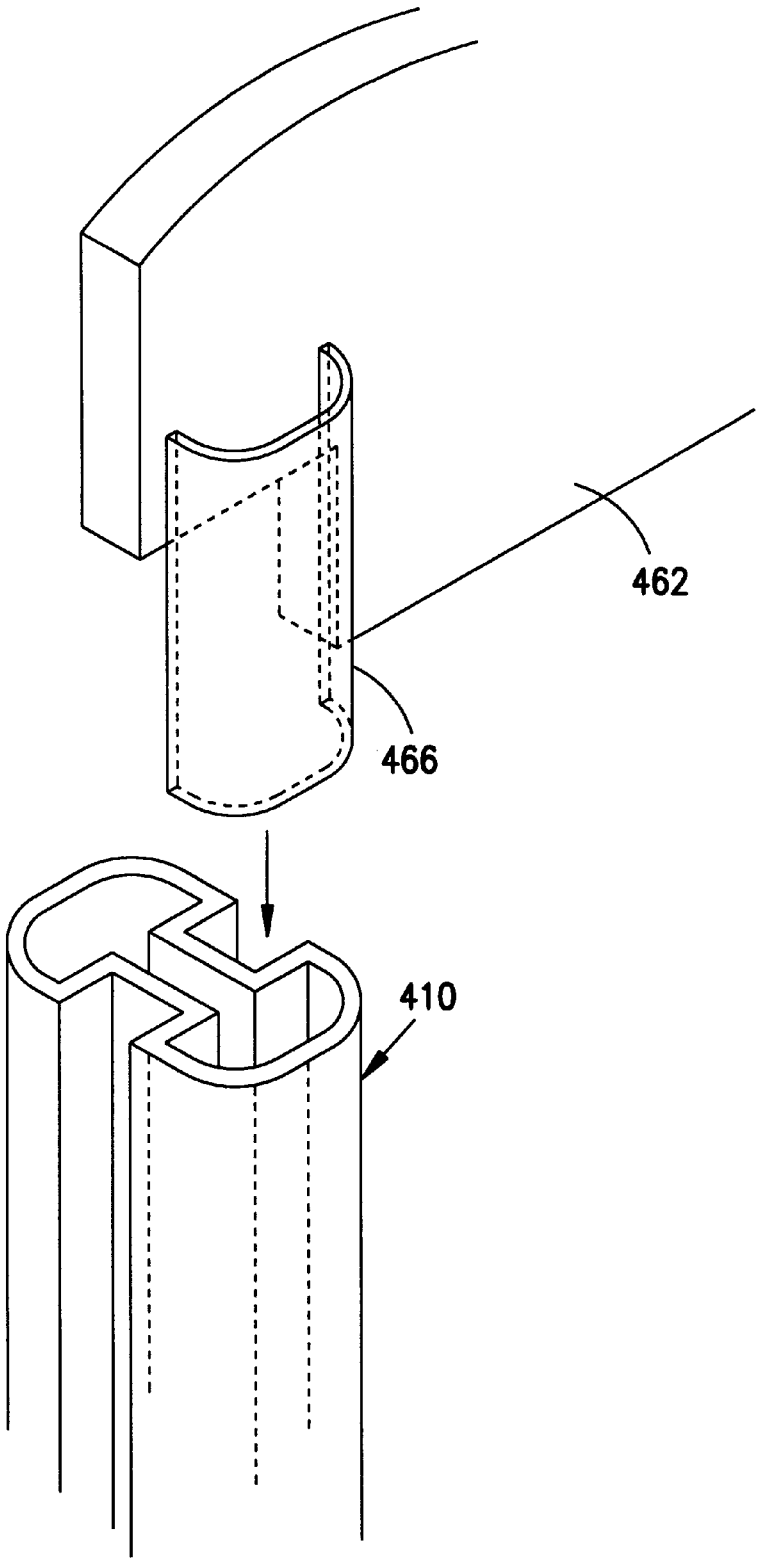
FIG. 12B is a perspective view illustrating the top header of FIG. 12A constructed in accordance with one embodiment of the organization system.

FIG. 12B illustrates in greater detail how the top header 462 will couple with a console post 410. In one embodiment, the coupling 466 comprises a male component which is received by the console post 410. Alternatively, the coupling 466 can also comprise a female component which receives the console post 410 therein. The coupling 466 can be modified in a number of configurations as long as it still couples the top header 462 with the console unit, and still be considered within the scope of the invention.

Figure 12C:
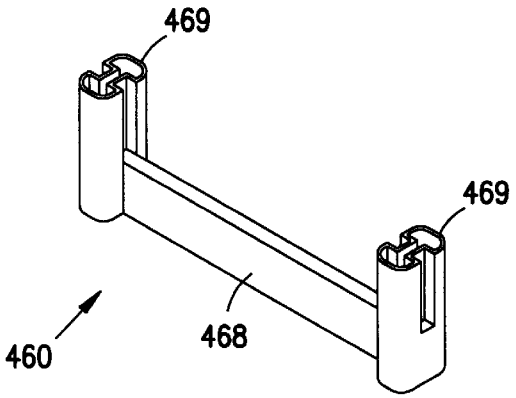
FIG. 12C is a perspective view illustrating a header constructed in accordance with yet another embodiment of the organization system.

FIG. 12C illustrates another configuration of the header 460. In this configuration, the header 460 comprises a console cap 468. The console cap 468 has at least one coupling 469 for engaging with the console post 410. The coupling 469 can be provided as a male coupling or a female coupling. In addition, either a single coupling or a plurality of couplings can be incorporated with the header 460. Advantageously, the console cap 468 can be assembled to either the top or bottom, or both, of the console unit 400 and provides for a more stable structure for the console unit 400. The assembled console unit 400 is shown in FIG. 1. The console unit 400 in another embodiment, includes a header 460, console post 410, and can include storage devices such as a console shelf 470, and/or a drawer 500.

Figure 13A:
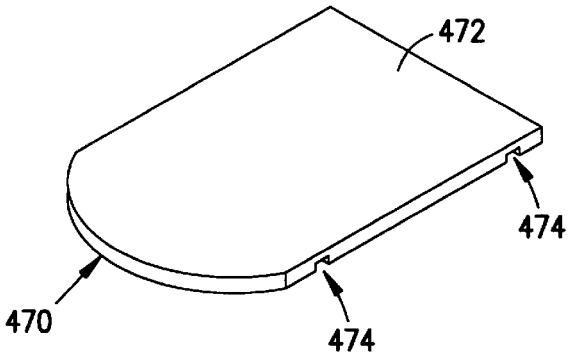
FIG. 13A is a perspective view illustrating a console shelf constructed in accordance with one embodiment of the organization system.
Figure 13B:
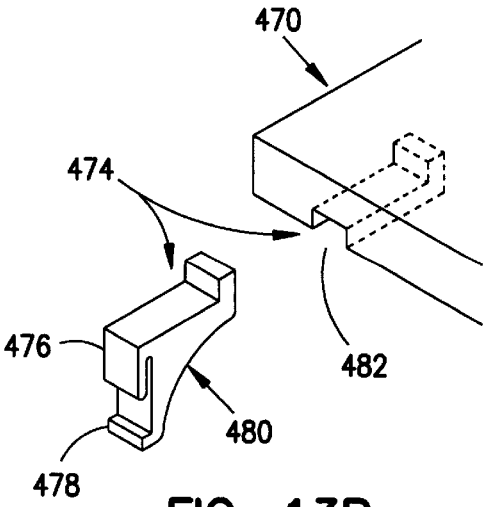
FIG. 13B is a perspective view illustrating a console shelf constructed in accordance with one embodiment of the organization system.

As illustrated in FIGS. 13A and 13B, the console shelf 470 has a shelving area 472 and coupling features 474. In one embodiment, the coupling features 474 are integral with the console shelf 470. Alternatively, the coupling features 474 are separate, as shown in FIG. 13B. The coupling features 474 allow the console shelf 470 to be secured with other components of the organization system 100 such as the console unit 400. The coupling features 474, in one embodiment, comprise a coupling insert 480, and a cut out 482 in the console shelf 470. The coupling insert 480 is adapted to engage with the console shelf 470. In one embodiment, the coupling insert 480 has a peg 476 and a leg member 478 for engaging with openings on the console post. However, the coupling members 474 can take on a number of configurations to couple with other components of the organization system 100. Using the coupling members 474, the console shelf 470 can be secured with the console post 410. The plurality of openings and cutouts on the console posts 410 allow for the console shelf 470 to be adjustable and installed anywhere a user desires. In addition, the console shelf 470 can be removed and reinstalled into alternative locations pursuant to the user's needs. In addition or alternative to shelving, a drawer can also be provided as part of the console unit 400.

Figure 14B:
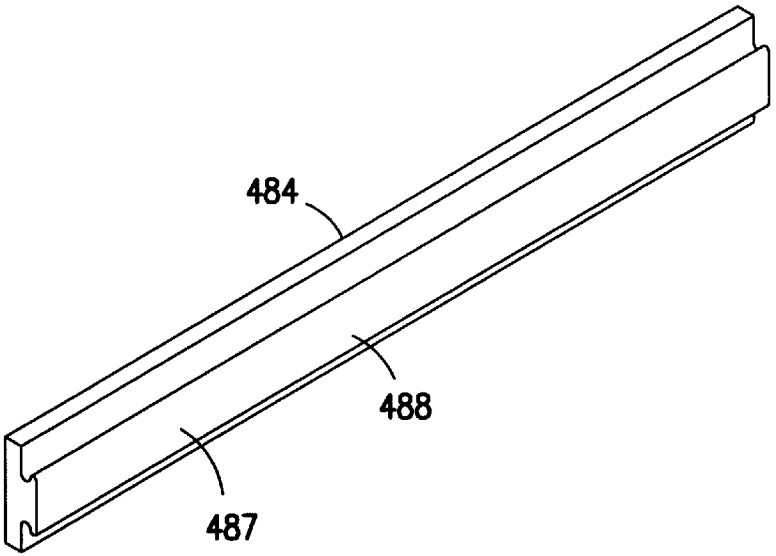
FIG. 14B is a perspective view illustrating a drawer rail constructed in accordance with yet another embodiment of the organization system.
Figure 14A:
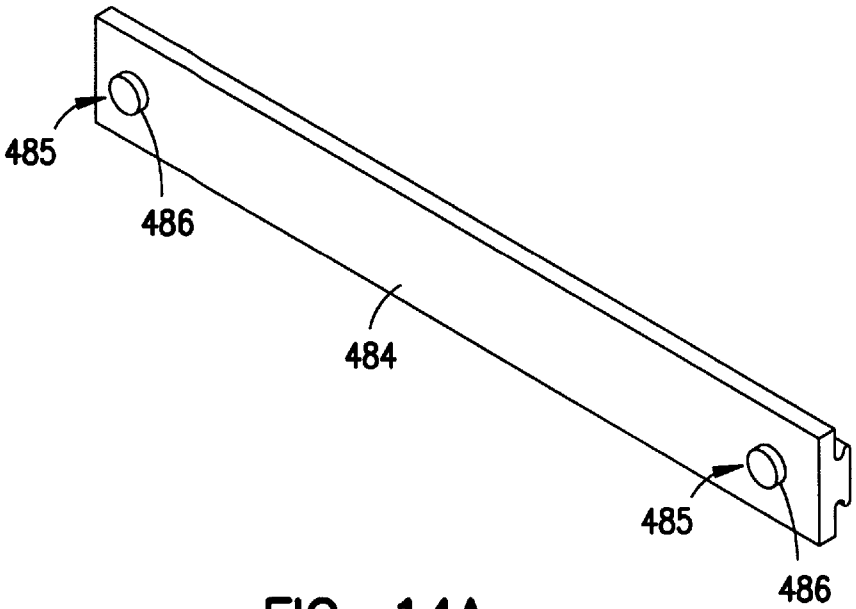
FIG. 14A is a perspective view of a drawer rail constructed in accordance with another embodiment of the organization system.

To secure a drawer within a console unit 400 in one embodiment, a rail 484 is provided which couples with the console unit 400. The rail 484 can be provided as a single continuous rail, or a plurality of rails 484 can be provided. As illustrated in FIGS. 14A and 14B, the rail 484 has attachment features 485 to attach the rail 484 to the console unit 400, and also include engagement features 487 to engage a drawer. In one embodiment, the attachment features 485 of the rail 484 include a peg 486. In one embodiment, the peg 486 has a cylindrical portion and a flanged portion to engage with the opening of the console posts 410. Alternatively, the attachment features 485 can include a peg and leg member as discussed above for the coupling insert 480. The rail 484 can be assembled and disassembled from the console posts, making the drawer placement both easy to install, disassemble, and adjustable. In another embodiment, the engagement features 487 of the rail 484 include a drawer guide 488 which couples with the drawer 500 as will be further discussed below.

Figure 15:
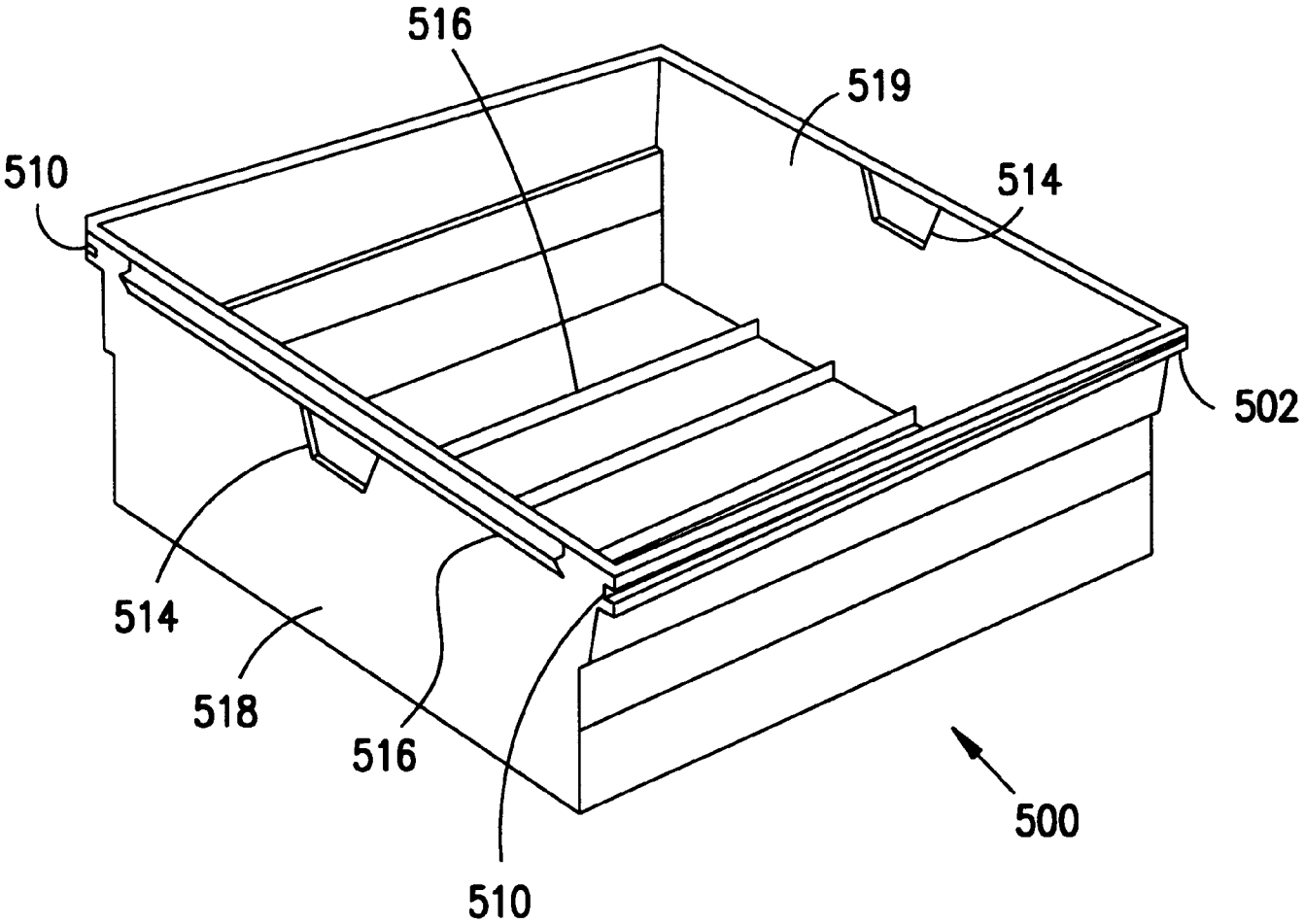
FIG. 15 is a perspective view illustrating a drawer constructed in accordance with one embodiment of the organization system.

FIG. 15 illustrates a first embodiment of a drawer 500 to be used with the organization system 100, and an alternative embodiment of the rail 484. The drawer 500 includes drawer engaging features 502 to couple with the engagement features 487 of the rail 484 of the console unit 400. In one embodiment, the drawer 500 is slidably coupled with the rail 484. In another embodiment, the drawer 500 can be stationary relative to the console unit 400 and can be directly mounted thereto. In another embodiment, the drawer 500 includes a track member 510 for slidably engaging with the drawer guide 488. In addition, the drawer 500 can also include a handle 514. In another embodiment, the drawer 500 can include a handle 514 in a front surface 518 and a handle 514 on a rear surface 519. Having multiple handles on the drawer 500 allows for a user to easily remove the drawer 500 from the console unit and carry the drawer with the contents therein to another location, or perhaps another console unit 400. The drawer 500 can also include strengthening structures to help reinforce the structure of the drawer 500. For instance, a rib 516 can be disposed in one of the surfaces of the drawer.

Figure 16A:
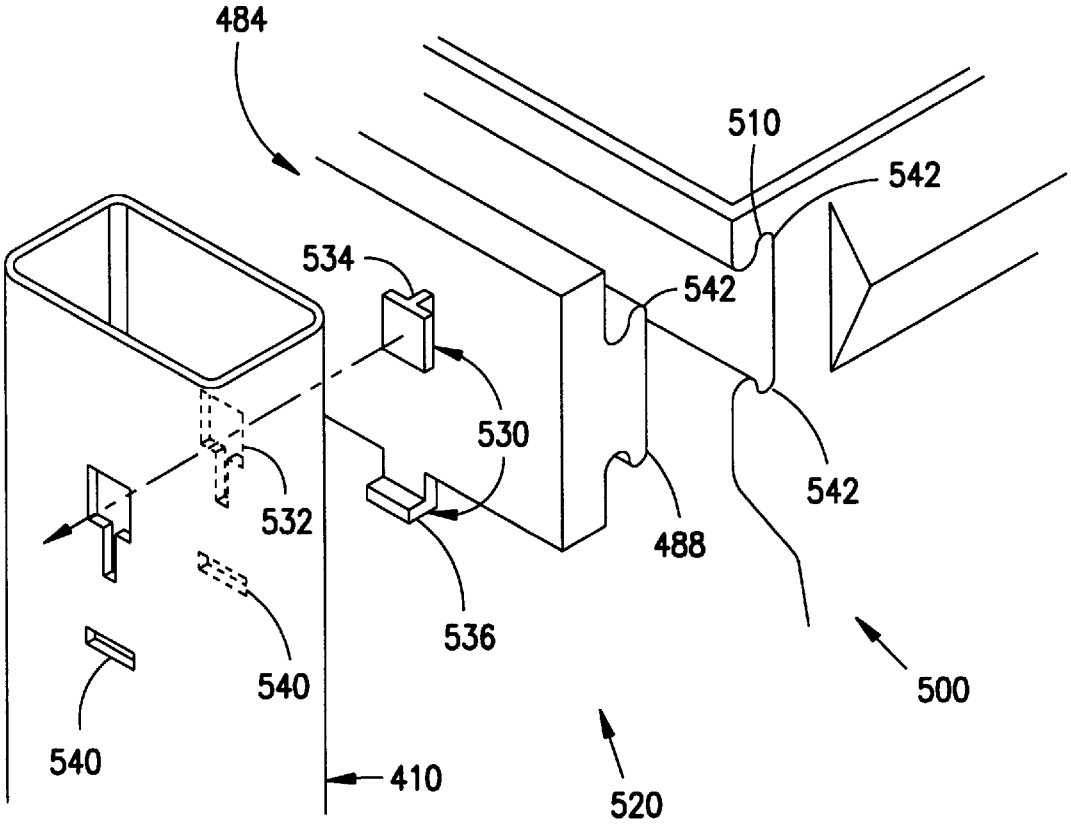
FIG. 16A is an exploded perspective view illustrating a drawer assembly constructed in accordance with one embodiment of the organization system.
Figure 16B:
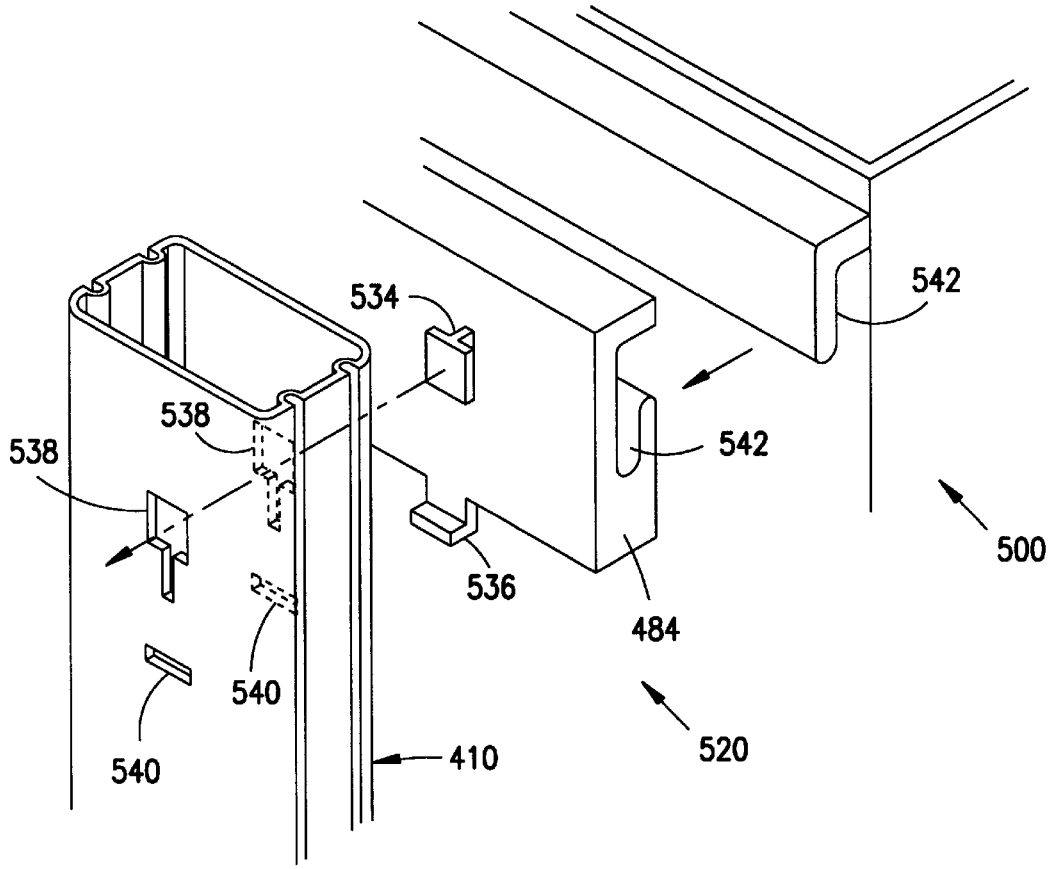
FIG. 16B is an exploded perspective view illustrating a drawer assembly constructed in accordance with another embodiment of the organization system.

FIGS. 16A and 16B illustrate one embodiment of a drawer assembly 520, showing one example of how a drawer 500 would couple with a console post 410. In this embodiment, attachment features 530 on another embodiment of the rail 484 couples with an opening 532 on the console post 410. The attachment features 530, in one embodiment, comprise a peg 534 and a leg member 536 which engage with an opening 538 and a slot 540 of the console post 410. To install the rail 484, or any other component having similar structure, the peg 534 is first inserted into the opening 538. The peg 534 is then slid down the opening 538 until, in one embodiment, the leg member 536 is aligned with the slot 540. The leg member 536 is then snapped into the slot 540 and the component is coupled with the console post 410. After the rail 484 is installed to the console post 410, the drawer 500 is then slid over the rail 484 such that the track 510 on the drawer couples with the guide 488 on the rail 484. Alternatively, the track 510 can be formed in rail 484 and the guide 488 can be formed on the drawer 500 as shown in FIG. 16B. In another embodiment, the guide 488 and the track 510 each have a vertical component 542. The vertical component 542 of the guide 488 and the track 510, in combination with close fitting track 510 and guide 488, allow for the console posts 410 on either side of the drawer 500 to be more securely coupled together. This type of configuration creates a more secure structure for the console 400 and also prevents the console 400 from rocking back and forth during use.

The organization system 100 permits a wide variety of assemblies to be configured with the components provided. The number of adjustable shelving apparatuses to be used can vary from one to several. In addition, several console units can be formed where shelving can be placed at any level and adjusted to different levels or eliminated. In addition, multiple drawers can be provided, where the drawers can have different sizes and can be placed at different heights depending on the needs of the user. In addition, the location of the console units can be modified whenever a user desires.

Figure 18:
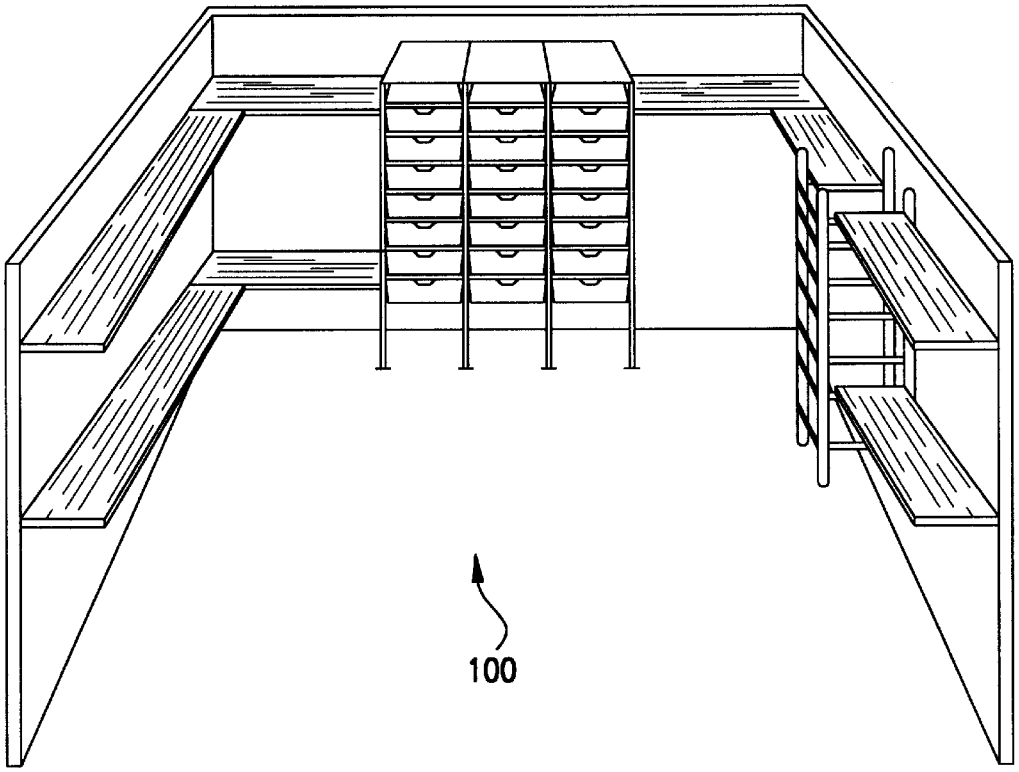
FIG. 18 is a view illustrating an organization system constructed in accordance with one embodiment of the present invention.

FIGS. 17–19 illustrate different examples of use for the organization system 100. These figures are exemplary only, and are not intended to limit the scope of the invention in any manner. As can be seen from the drawings, many configurations of the organization system 100 are possible since single or multiple components can be provided.

Advantageously, the adjustable shelving of the closet organization system can accommodate many different closets having different widths. This provides a user the added benefit of not having to worry about accurate measurement prior to purchasing the shelving. In addition, a user does not need to cut the shelving to fit, which is desirable since no cutting tools are necessary during the installation process. Eliminating the cutting process from the installation of the shelving also eliminates jagged edges at the ends of the shelves, which can snag and damage clothing. The adjustable shelf also eliminates the frustration and cost of making mistakes in cutting the shelving material. Another benefit is that the shelving can be made from recycled materials, and themselves be recycled.

The closet organization system provides many advantages over conventional systems. For instance, the closet organization system accommodates numerous sizes and configurations of different spaces where the system is needed. In addition, the closet organization system can be assembled, disassembled, removed and altered with minimal skill and with use of a single tool, the Phillips Head screwdriver, and also without significantly marring the wall. The closet organization system locks together to form a sturdy and strong structure, yet can be disassembled with speed and ease. The structure of the closet organization system is inexpensive to manufacture and is capable of being compactly stored when disassembled since it is extruded of inexpensive and lightweight plastic. The compactness and lightweight features allow for the organization system to be conveniently provided to consumers in the form of kits, which can vary depending on the areas in need of organization. When an individual moves from a house, a townhome, a condo, an apartment, or the like, the closet organization system can be removed and relocated with the individual.

It is to be understood that the above description is intended to be illustrative, and not restrictive. Many other embodiments will be apparent to those of skill in the art upon reviewing the above description. For instance, the mounting projections and the mounting openings of the various components can be disposed on either or both of the mating components. The scope of the invention should, therefore, be determined with reference to the appended claims, along with the full scope of equivalents to which such claims are entitled.

What is claimed is:

1. An organizational system comprising:

a console unit having four console posts, each of the console posts having console apertures;

a top header coupled with at least two of the console posts;

at least one shelf coupled between at least two of the console posts;

at least one drawer assembly coupled between at least two of the console posts, wherein the drawer assembly comprises:

a drawer having a first engaging profile disposed on two sides of the drawer, a first drawer rail and a second drawer rail each having a second engaging profile, where the first engaging profile of the drawer is slidably engaged by the second engaging profile of the first and second drawer rails;

the first drawer rail and the second drawer rail being coupled with the console posts;

at least one adjustable shelving apparatus, the adjustable shelving apparatus comprising at least one first cross member with a first side and at least one second cross member with a second side, wherein the at least one first and second cross members have a lateral restraint means, comprising a T-shaped slot defined on the first side of the first cross member, and a T-shaped post on the second side of the second cross member, whereby the T-shaped post slidably engages the T-shaped slot of adjoining cross members, wherein the at least one first cross member is slidably engaged with the at least one second cross member, wherein the lateral restraint means prevents the at least one first and second cross members from disengaging laterally;

a first and a second end bracket each coupled with the adjustable shelving apparatus, where at least one of the end brackets are coupled with at least two of the console posts; and at least one adjustable clothes rod coupled with the adjustable shelving apparatus, said adjustable clothes rod comprising at least one first rod member slidably coupled with at least one second rod member.

2. An organizational system comprising:

an adjustable shelving apparatus comprising at least one first cross member with a first side and at least one second cross member with a second side, wherein the at least one first and second cross members have a lateral restraint means, comprising a T-shaped slot defined on the first side of the first cross member, and a T-shaped post on the second side of the second cross member, whereby the T-shaped post slidably engages the T-shaped slot of adjoining cross members, wherein the at least one first cross member is slidably engaged with the at least one second cross member, whereby the lateral restraint means prevents the at least one first and second cross members from disengaging laterally.

3. The organizational system as recited in claim 2, further comprising at least one bracket coupled with the adjustable shelving apparatus.

4. The organizational system as recited in claim 3, further comprising an anchor bolt coupled with the end bracket, the anchor bolt for mounting the end bracket and the shelving apparatus to a mounting surface.

5. The organizational system as recited in claim 3, further comprising at least two console posts coupled to the adjustable shelving apparatus.

6. The organizational system as recited in claim 5, further comprising at least one storage device coupled between the at least two console posts and forming at least one storage area therebetween.

7. The organizational system as recited in claim 6, wherein the at least one storage device comprises a console shelf.

8. The organizational system as recited in claim 6, wherein the at least one storage device comprises a drawer assembly.

9. The organizational system as recited in claim 5 and further comprising a mechanism for coupling the console posts with a mounting surface.

10. The organizational system as recited in claim 9, further comprising a bracket adapted to couple a first adjustable shelving assembly transverse to a second adjustable shelving assembly.

11. The organizational system as recited in claim 3, further comprising a cam lock assembly associated with the adjustable shelving apparatus, wherein the cam lock assembly secures the adjustable shelving apparatus with at least one of the console posts.

12. The organizational system as recited in claim 11, wherein the cam lock assembly comprises a cam lock and a cam pin, wherein the cam pin is secured to a portion of the adjustable shelving apparatus.

13. The organizational system as recited in claim 3, further comprising at least one adjustable clothes rod coupled with the adjustable shelving apparatus, said adjustable clothes rod comprising at least one first rod member slidably coupled with at least one second rod member.

14. The organizational system as recited in claim 3, further comprising end brackets coupled with a first end and a second end of the adjustable shelving apparatus, and coupling features disposed on the end brackets.

15. The organizational system as recited in claim 14, wherein the coupling features comprise a cut out for receiving a coupling insert, the coupling insert being adapted to couple a portion of the adjustable shelving apparatus with at least one console post.

16. The organizational system as recited in claim 14, wherein the coupling insert has a peg and a leg member associated therewith.

17. The organizational system as recited in claim 14, wherein the end brackets each have a bore therethrough, the bore adapted to receive a clothes rod therein.

18. The organizational system as recited in claim 2, further comprising a console unit coupled proximate to the adjustable shelving apparatus.

19. The organizational system as recited in claim 2, wherein the organizational system is comprised of antifungal plastic.

* * * * *